US010677455B2

(12) United States Patent
Kyritsis

(10) Patent No.: US 10,677,455 B2
(45) Date of Patent: Jun. 9, 2020

(54) ELECTROSTATICALLY MANIPULATED FLAMES FOR COMPACT HEAT GENERATION

(71) Applicant: Khalifa University of Science and Technology, Abu Dhabi (AE)

(72) Inventor: Dimitrios C. Kyritsis, Abu Dhabi (AE)

(73) Assignee: Khalifa University of Science and Technology, Abu Dhabi (AE)

( * ) Notice: Subject to any disclaimer, the term of this patent is extended or adjusted under 35 U.S.C. 154(b) by 177 days.

(21) Appl. No.: 15/739,641

(22) PCT Filed: Jun. 24, 2016

(86) PCT No.: PCT/US2016/039376
§ 371 (c)(1),
(2) Date: Dec. 22, 2017

(87) PCT Pub. No.: WO2016/210336
PCT Pub. Date: Dec. 29, 2016

(65) Prior Publication Data

US 2018/0313534 A1 Nov. 1, 2018

Related U.S. Application Data

(60) Provisional application No. 62/184,005, filed on Jun. 24, 2015.

(51) Int. Cl.
*F23C 99/00* (2006.01)
*F23D 14/84* (2006.01)

(52) U.S. Cl.
CPC ..... *F23C 99/001* (2013.01); *F23D 14/84* (2013.01)

(58) Field of Classification Search
CPC . F23D 14/84; F23N 5/265; F23N 5/00; F23N 5/12; F23N 5/26; F23N 5/126; F23C 99/001; F23C 5/14; H01T 23/00
See application file for complete search history.

(56) References Cited

U.S. PATENT DOCUMENTS

| | | | |
|---|---|---|---|
| 3,358,731 | A | 12/1967 | Donnelly et al. |
| 3,416,870 | A | 12/1968 | Wright |
| 4,439,980 | A | 4/1984 | Biblarz et al. |
| 4,875,850 | A | 10/1989 | Cagnon et al. |
| 2012/0023950 | A1 | 2/2012 | Weeks et al. |
| 2013/0156968 | A1 | 6/2013 | Petorak et al. |

OTHER PUBLICATIONS

PCT/US2016/039376 , "International Preliminary Report on Patentability", dated Jan. 4, 2018, 7 pages.
PCT/US2016/039376 , "International Search Report and Written Opinion", dated Sep. 14, 2016, 10 pages.

*Primary Examiner* — Alfred Basichas
(74) *Attorney, Agent, or Firm* — Kilpatrick Townsend & Stockton LLP

(57) ABSTRACT

The location and morphology of an electrostatically manipulated flame can be controlled through the action of an electrostatic field on the flame, virtually independently of overall mixture composition and imposed strain rate. An electrostatically controlled burner can manipulate a position of a flame between an oxidizer source and a fuel source by way of one or more electrodes configured to produce an electrostatic field proximate to one of the fuel source and the oxidizer source.

22 Claims, 13 Drawing Sheets

FIG. 18

```
ELEMENTS   H O N END
SPECIES    H2 H O2 O OH HO2 H2O2 H2O N N2 NO END
REACTIONS
   H2 + O2 = 2OH                    0.170E + 14     0.00      47780
   OH + H2 = H2O + H                0.117E + 10     1.30       3626
   O + OH = O2 + H                  0.400E + 15    -0.50          0
   O + H2 = OH + H                  0.506E + 05     2.67       6290
   H + O2 + M = HO2 + M             0.361E + 18    -0.72          0
            H2O/18.6 /  H2/2.86 /  N2/1.26 /
   OH + HO2 = H2O + O2              0.750E + 13     0.00          0
   H + HO2 = 2OH                    0.140E + 15     0.00       1073
   O + HO2 = O2 + OH                0.140E + 14     0.00       1073
   2OH = O + H2O                    0.600E + 09     1.30          0
   H + H + M = H2 + M               0.100E + 19    -1.00          0
            H2O/0.0 /   H2/0.0 /
   H + H + H2 = H2 + H2             0.950E + 17    -0.60          0
   H + H + H2O = H2 + H20           0.600E + 20    -1.25          0
   H + OH + M = H2O + M             0.160E + 23    -2.00          0
            H2O/5 /
   H + O + M = OH + M               0.620E + 17    -0.60          0
            H2O/5 /
   O + O + M = O2 + M               0.189E + 14     0.00      -1788
   H + HO2 = H2O2 + O2              0.125E + 14     0.00          0
   HO2 + HO2 = H2O2 + O2            0.200E + 13     0.00          0
   H2O2 + M = OH + OH + M           0.130E + 18     0.00      45500
   H2O2 + H = HO2 + H2              0.160E + 13     0.00       3800
   H2O2 + OH = H2O + HO2            0.100E + 14     0.00       1800
   O + N2 = NO + N                  0.140E + 15     0.00      75800
   N + O2 = NO + O                  0.640E + 10     1.00       6280
   OH + N = NO + H                  0.400E + 14     0.00          0
END
```

FIG. 19

```
OH                  RUS 780    1H      1            G     200.000     3500.000     1000.000    1
 3.09288767E + 00   5.48429716E - 04   1.26505228E - 70 - 8.79461556E - 11  1.17412376E - 14   2
 3.85865700E + 03   4.47669610E + 00   3.99201543E + 00 - 2.40131752E - 03  4.61793841E - 06   3
-3.88113333E - 09   1.36411470E - 12   3.61508056E + 03 - 1.03925458E - 01                      4
```

ELECTROSTATICALLY MANIPULATED FLAMES FOR COMPACT HEAT GENERATION

CROSS-REFERENCES TO RELATED APPLICATIONS

The present application is the U.S. national stage of PCT/US2016/039376, filed Jun. 24, 2016, which claims benefit of U.S. Provisional Application No. 62/184,005 filed Jun. 24, 2015, all of which are hereby incorporated by reference in their entirety for all purposes.

BACKGROUND

The physics of non-premixed flames is by now well understood. In fact, the structure of such flames has been analyzed mathematically in its entirety in a masterly article by Liñán (1974), which concluded the theoretical work that was initiated by the seminal work of Burke and Schumann (1928). This line of work has established that, for large activation energies (i.e. for all practical flames), the location of the flame as well as several of its properties (e.g. maximum temperature, fuel mass flow rate etc.) are basically determined by mixing. The reactants diffuse into each other and the non-premixed flame establishes itself pretty much like a sheet at the location where the two reactants mix at stoichiometric proportion. This introduces a coupling between the mechanical and chemical characteristics of the flame and its morphology that complicates flame management in practical burners. It is e.g. a matter of everyday experience that by increasing the fuel flow rate of a jet flame we also affect its height, or that there are limitations as to how close to solid surfaces non-premixed flames can sit because of the need for mixing to work.

The early realization that flames contain ions (Lewis (1931), Calcote (1957)) introduced the intriguing possibility of electric control of flames. If one can act on the dilute plasma that the flame generates with appropriately tailored electric fields, it is conceivable that one could affect flame morphology (in a manner that would e.g. be favorable for the purposes of heat transfer) in a way that would be independent of the mechanical and chemical characteristics of the reactive flow. It is by now well-established (Goodings et al. 1979 I & II), that although flames are not hot enough to generate thermal plasmas, some of the combustion intermediates are charged. Exactly because of their chemical nature, these ions are called chemi-ions. Their precise nature has been discoursed intensely in the literature, but the mechanism described in detail in the recent paper by Belhi et al. (2010) that involves the formation of $HCO^+$ and $H_3O^+$ seems to be gaining acceptance.

A first line of work in the context of electrostatic manipulation of combustion was the one that related to the combustion of electrostatically charged sprays and solid-particle suspensions. The idea was proposed by Thong and Weinberg (1971) and was followed up by several researchers (Ueda et al., 2002, Okai et al. 2004, Yamamshita and Imamura 2008, Anderson et al. 2008), among which A. Gomez and his collaborators at Yale have provided the most long-lasting and impactful line of work on electrospray combustion (Tang and Gomez (1994), Kyritsis et al. (2004), Lenguito et al. (2014)). Then, there has been substantial work on plasma-assisted combustion (Papac and Dunn-Rankin (2007), Ju and Sun (2015)) although it is realized that introduction and effective control of plasmas requires a very specific set of technologies and that the results, especially as it relates to soot generation, are not always favorable.

Notably, technologies that would involve acting directly on the chemi-ions, without the need for a charged liquid fuel or the generation of the plasma have received very little attention. However, recent analyses have provided data that suggest that this might be possible. In a series of elegant experiments, S. H. Chung and his collaborators showed that electrostatics can affect jet-flame stabilization in a pretty substantial manner (Kim et al. 2012). Laminar flame stabilization was also studied numerically by Belhi et al. (2010), who provided a chemical mechanism for the generation of chemi-ions that was adapted to DNS of laminar flames. The proposed model was somewhat simplified compared to the detailed chemistry proposed in the early work of Goodings et al. (1979 I & II), who established chemi-ions as the main mechanism of charge generation.

BRIEF SUMMARY

In the present disclosure, we explore the possibility of control of the location of a non-premixed counterflow flame through electrostatic manipulation. Of particular importance is whether the flame location can be determined through electrostatic actuation without altering the macroscopic chemical and mechanical characteristics of the flame (overall mixture strength and imposed strain rate). To this end, a counterflow, $N_2$-diluted, methane-oxygen flame was studied in an appropriately configured experimental burner and a computational framework was established in ANSYS-Fluent.

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

According to certain embodiments of the present disclosure, a method of manipulating a flame can include generating a stable flame between a fuel source and an oxidizer source, generating an electrostatic field proximate to one of the fuel source and the oxidizer source by way of one or more electrodes, and changing at least one of a position and a shape of the flame by applying a voltage to one or more of the one or more electrodes. The fuel source and the oxidizer source may be arranged in a counter-flow arrangement. The one or more electrodes may include a first electrode positioned proximate to, or across, one of the fuel and oxidizer sources. In some cases, the one or more electrodes may alternatively, or in addition, include a second electrode positioned proximate to, or across, the other of the fuel and oxidizer sources.

According to certain other embodiments of the present disclosure an electrostatically controlled burner can include a fuel source and an oxidizer source arranged proximate to the fuel source. One or more electrodes can be positioned proximate to at least one of the fuel source and the oxidizer source, and configured to produce an electrostatic field between the fuel source and the oxidizer source sufficient to change a shape of a flame produced between the fuel source and the oxidizer source. In some cases, the fuel source and the oxidizer source can be arranged in a counter-flow arrangement. A coolant chamber may be connected with one of the fuel source and the oxidizer source and configured to cool one of the fuel source and the oxidizer source. A shroud nozzle may be connected with one of the fuel source and the oxidizer source and configured to emit a gaseous shroud between the fuel source and the oxygen source and arranged to protect a flame maintained therebetween.

In some cases, an electrostatically controllable burner can also include a first electrode and a second electrode, where the first electrode is positioned proximate to the oxidizer source and the second electrode is positioned proximate to the fuel source. A power supply can be connected to at least one of the first and second electrode such that the power supply generates a voltage difference between the first and second electrode sufficient to generate the electrostatic field.

BRIEF DESCRIPTION OF THE DRAWINGS

FIG. 18 shows an example of a chemical kinematics input file for a hydrogen-oxidation reaction model; and FIG. 19 shows an example of thermodynamics data associated with OH species for use in a reaction model.

DETAILED DESCRIPTION

The subject matter of embodiments of the present disclosure is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

Apparatus

Figure 1:
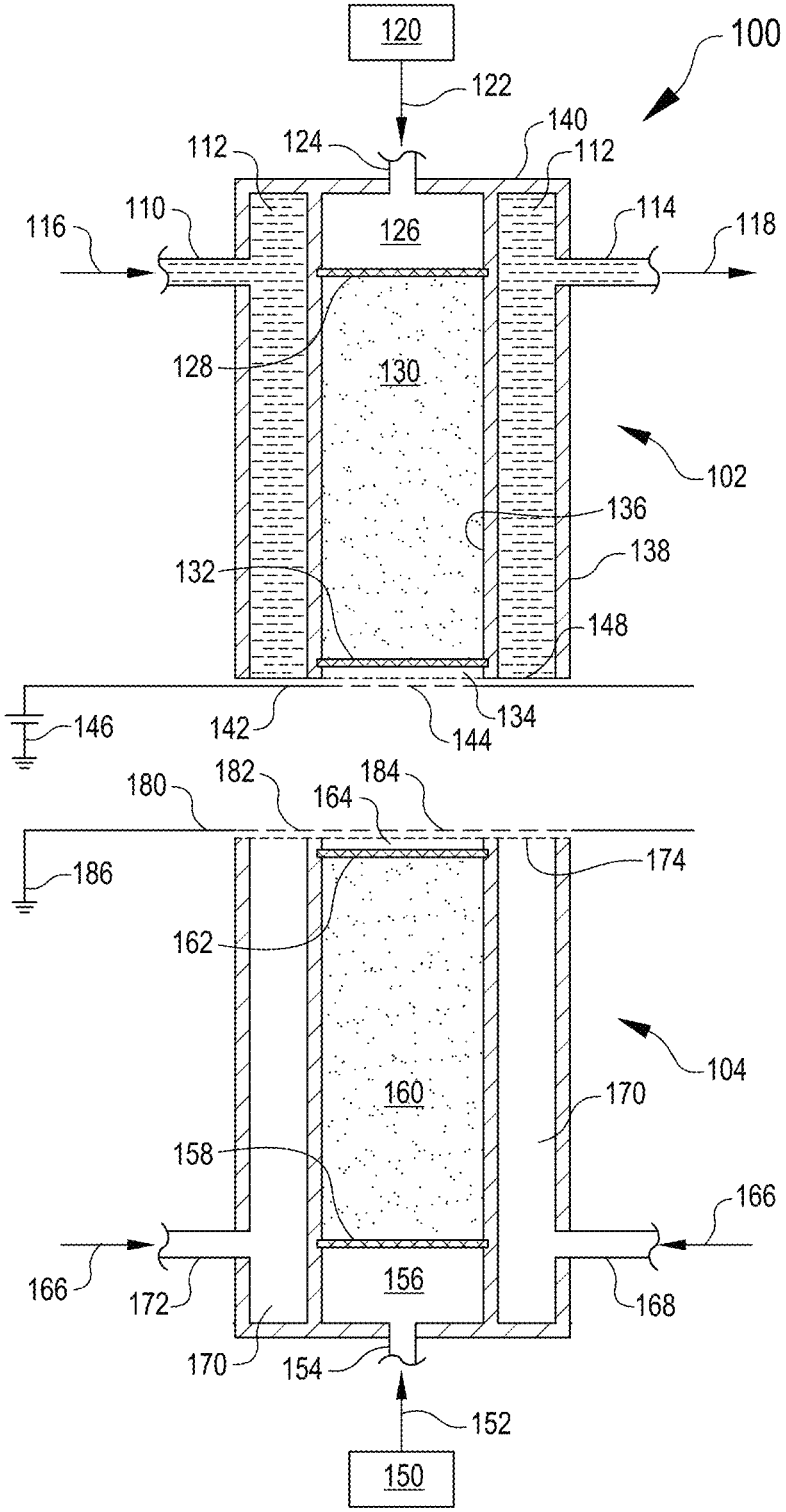
FIG. 1 shows a schematic illustration of a counter-flow burner, in accordance with embodiments.

FIG. 1 shows a counter-flow burner 100 for electrostatically maintaining a flame. The counter-flow burner 100 includes two opposed sources, a fuel source 102 and an oxidizer source 104, aligned in a counter-flow configuration as shown schematically in FIG. 1, and established in atmospheric ambiance.

An axisymmetric, laminar methane-oxygen, $N_2$-diluted flame can be established between the fuel source 104 and oxidizer source 102 forming a burner that can be used similarly with hydrocarbon gaseous fuels (ethane, propane, butane), vaporized hydrocarbons, as well as oxygenated fuels (alcohols, biodiesel, etc.)

At the oxidizer source 102, an oxidizer stream 122 can be delivered from a reservoir 120 which may include oxygen diluted with nitrogen. The oxidizer stream 122 is supplied into an oxidizer inlet 124 to the upper oxidizer chamber 126. The oxidizer stream 122 flows through a first glass bead bed 130 and ultimately to the oxidizer nozzle exit 134. A fuel stream 152 from a fuel reservoir 150 flows into the fuel source 104 via a fuel inlet 154. The fuel stream 152 can include a mixture of fuel and nitrogen. The fuel stream 152 passes through the upper fuel chamber 156, through the second glass bead bed 160 to the fuel nozzle exit 164. Both nozzle exits 134, 164 can be approximately 15 mm in diameter and the gap between them can be controllable, e.g. by translating one of the two sources 102, 104 relative to the other. In most of the experimental cases described below, the nozzles were separated by from 15 mm to 20 mm. However, in various embodiments, the nozzle exits 134, 164 may be any suitable size or geometry, and may be spaced at more than 20 mm, or less than 15 mm.

A separate nitrogen stream 166 can flow into a nitrogen chamber 170 through one or more nitrogen inlets 168, 172 and out through a shroud nozzle 174 to act as a gaseous shroud around the fuel nozzle exit 164, in order to protect a flame from interferences from the ambiance. Nitrogen streams, or other suitable inert gas streams, can also be used in order to extinguish a flame. In various embodiments, any suitable non-oxidizing, non-combusting gas may be passed through the shroud nozzle 174 and around the flame to protect the flame.

The oxidizer source 102 was cooled, e.g. by a coolant chamber 112, which takes an inlet coolant stream 116 through a coolant inlet 110 and exhausts an outlet stream 118 through a coolant outlet 114. In some cases, the coolant stream 116 is a water stream. The coolant chamber 112 is bounded by an inner wall 136, outer wall 138, and end walls 140, 148. The coolant chamber 112 can protect the oxidizer source 102 from the heat of a buoyant plume generated by a flame between the two sources 102, 104. In various embodiments, any suitable coolant may be passed around the oxidizer source 102 by way of the coolant chamber 112 to protect the oxidizer source from heat.

Glass bead beds 130, 160 can be used to provide uniform velocity profiles of both fuel and oxidizer at the nozzle exits 134, 164, respectively, and to help prevent flashback. At the oxidizer source 102, the oxidizer stream 122 can flow through the upper oxidizer chamber 126, through a first porous layer 128 and into the first glass bead bed 130, and ultimately out through a second porous layer 132 to the oxidizer nozzle exit 134. At the fuel source 104, the fuel stream 152 can flow through an upper fuel chamber 156, through a third porous layer 158 and into the second glass bead bed 160, and ultimately out through a fourth porous layer 162 into the fuel nozzle exit 164.

Two aluminum plates 142, 180 can be attached to each nozzle exit 134, 164, respectively, in order to act as electrodes and introduce an electric field, thus effectively creating a capacitor between the oxidizer and fuel sources 102, 104. Both plates 142, 180 were drilled and aligned with the nozzle exits 134, 164 to allow the passage of gas flow therethrough. An electrically conducting mesh 144, 184 was placed in the hole of each aluminum plates in order to secure as good of electric-field uniformity as possible. The lower plate 180, i.e. for the fuel source 104, can include peripheral openings 182 for nitrogen gas to pass therethrough, e.g. to be used as a shroud.

DC high voltage was applied between the two plates 142, 180 with a power supply 146 connected to two varying high-voltage power supply of LD-Didactic GmbH connected in series, which provided the capability to vary the applied voltage between 0 to 6 kV. In some cases, the lower plate 180 can be connected with ground 186. This yielded an overall electric field intensity that varied between 0 and 400 V/mm when the distance between the nozzles was about 1.5 cm. The proposed technology is expected to work for electric field strengths on the order of 100-1000 V/mm.

Figure 2:
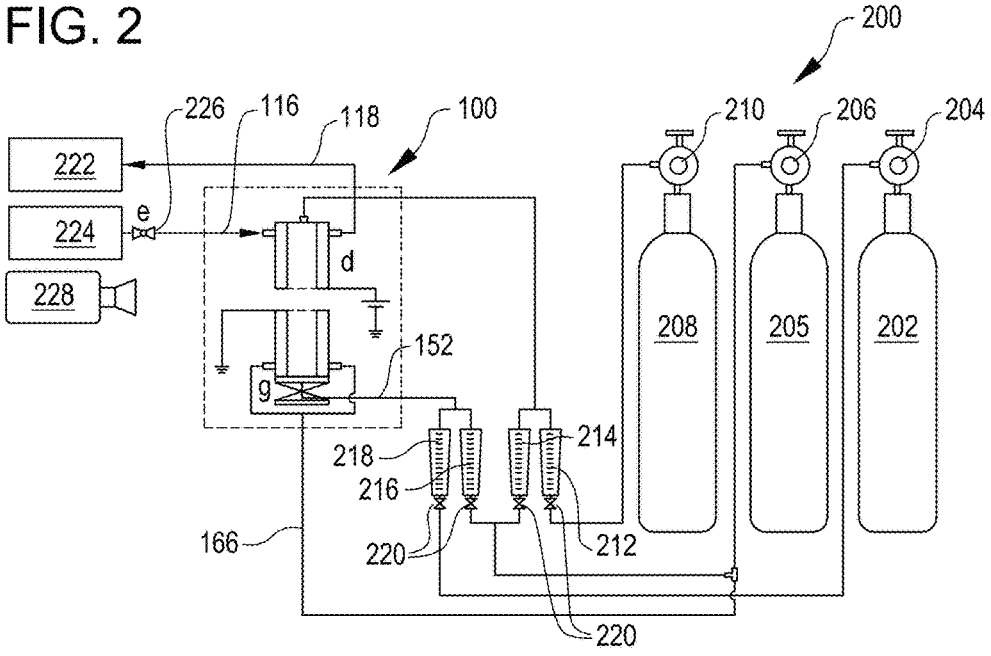
FIG. 2 shows an experimental apparatus for the counter-flow burner shown in FIG. 1.

FIG. 2 shows an experimental apparatus 200 for operating a counter-flow burner 100 shown in FIG. 1, in accordance with embodiments. The apparatus 200 includes a fuel gas reservoir 202, carrier gas reservoir 205, and oxidizer reservoir 208. The fuel gas reservoir 202 can contain gaseous CH4 or any other suitable fuel such as a hydrocarbon fuel. The carrier gas reservoir 205 can contain any suitable non-oxidizing non-combusting gas, such as nitrogen or any suitable inert gas. The oxidizer reservoir 208 can contain oxygen gas or any suitable oxidizer. Each of the gas reservoirs 202, 205, 208 is connected with a regulator 204, 206, 210 to control a rate of flow out from each reservoir.

In order to supply gases to the burner 100, oxygen from the oxidizer reservoir 208 was diluted with nitrogen from the carrier gas reservoir 205 by passing the respective gasses through valves 220 and rotarmeters 212, 214 to regulate a mixing rate of the oxygen gas with the nitrogen gas. A mixture of the oxygen gas and nitrogen gas was then supplied to the burner 100. At the same time, CH4 from the fuel reservoir 202 was combined with a flow of nitrogen from the carrier gas reservoir 205 by way of valves 220 and rotarmeters 218, 216 to form the fuel stream 152 which flows into the burner 100 as well. A separate nitrogen stream 166 flows from the carrier gas source to the burner 100. The coolant flow 116 was passed from a coolant source 224, which may be a water source, by way of a valve 226 to the burner, and removed from the burner by way of an outlet stream 118 to an exhaust or drain 222.

The nitrogen, oxygen and methane gases were metered accurately using Matheson rotameters 212, 214, 216, 218; which provided volume flow rate measurements with an estimated error of ±5% as per the specs of the manufacturer. The flame behavior was visualized using Andor's iStar® DH320T intensified CCD camera and a Nikon® D3200 digital video camera.

Experiments were conducted at a constant fuel flow rate and selected oxygen flow rates corresponding to particular inlet oxygen-fuel ratios. In the experiments, the overall equivalence ratio varied from 0.6 to 1.4. The speed at the fuel nozzle varied from 25 to 65 cm/s. The burner operated in the following manner: After setting the fuel and oxygen flow rates, nitrogen was gradually added to the fuel and oxygen stream to maintain a flat flame centered in the burner. The flame behavior within the burner 100 was visualized using one or more cameras 228, e.g., using Andor's iStar DH320T intensified CCD camera and a Nikon D3200 digital video camera.

Computational Methodology

In parallel to experimental observation of the phenomenology of electrostatically manipulated flames, emphasis was placed on the establishment of a high-fidelity computational tool that would enable the analysis of the underlying physics. To this extent, ANSYS® Fluent was used to simulate the phenomena. The phenomenon of electrostatically manipulated flames was analyzed by setting up a computational framework of the electrostatically manipulated reactive flow in ANSYS Fluent (ANSYS Release 16.0, Help System, ANSYS Fluent Theory Guide. ANSYS Inc., 2015). The purpose of the computational study was to investigate the fundamental distinctive physics associated with the action of electrostatics with a particular emphasis on ionic wind and preferential diffusion.

Governing Equations

To describe a reactive flow, the conservation principles were applied for mass, momentum, and energy, and an evolution equation was employed for each chemical species involved. These governing equations were solved computationally using the ANSYS-Fluent platform. The reactive flow was modeled as steady, laminar flow using an axisymmetric computational domain. In our calculations, body forces were ignored with the exception of the electrostatic one, and so were thermal diffusion and radiative heat transfer.

The mass conservation equation for a steady flow is:

$$\nabla\cdot(\rho u)=0.$$

$\nabla\cdot$ is divergence. In cylindrical coordinates, $$\nabla\cdot\xi\equiv\left(\frac{1}{r}\frac{\partial(r\xi_r)}{\partial r}+\frac{\partial\xi_z}{\partial z}\right),$$

for any vector quantity $\xi$. $\rho$ is the mixture mass density and u the mixture velocity vector. Additionally, linear momentum conservation yields $$\nabla\cdot(\rho uu^T+pI-\tau)=S_e,$$

Here, I is the identity matrix and therefore the above equation can be represented in the radial and axial momentum as r—momentum:

$$\rho\left(u_r\frac{\partial u_r}{\partial r}+u_z\frac{\partial u_r}{\partial z}\right)=-\frac{\partial p}{\partial r}-\left[\frac{1}{r}\frac{\partial}{\partial r}(r\tau_{rr})+\frac{\partial}{\partial z}\tau_{zr}\right]+S_{e_r},$$

z—momentum:

$$\rho\left(u_r\frac{\partial u_z}{\partial r}+u_z\frac{\partial u_z}{\partial z}\right)=-\frac{\partial p}{\partial z}-\left[\frac{1}{r}\frac{\partial}{\partial r}(r\tau_{rz})+\frac{\partial}{\partial z}\tau_{zz}\right]+S_{e_z}.$$

The viscous stress tensor $\tau$ was calculated in terms of dynamic viscosity $\mu$ $$\tau=-\mu\left(\nabla u+(\nabla u)^T-\frac{2}{3}(\nabla\cdot u)I\right).$$

In the presence of an electric field, an electric force exerted on the charged molecules must be considered. The term $S_e$ represents the electric body force per unit volume applied on the charged species and was calculated as:

$$S_e=qE(n^+-n^-).$$

Here, q is the electron charge ($q=1.602\times10^{-19}$ C) and $n^+$ $n^-$ represent the concentration of the positively and negatively charge species, respectively. E is the electric field intensity that is related to the electric potential V by $$E=-\nabla V.$$

Since the number density of the charged species is particularly low, the effect of the space charge on the electric field is neglected and in the current work, the electric field intensity is assumed to be constant. The electric field was applied only in the axial-direction of the computational domain, which resulted in a source of the electrical body force $S_e$ in the axial-momentum equation only.

The species evolution equation for species i is $$\nabla\cdot(\rho uY_i+J_i^m+J_i^e)=\overline{M}_i\dot{\omega}_i,\ i=1,\ldots,N.$$

In a mixture that consists of N species, there are N−1 independent species evolution equations, because the mass fractions of all species should add up to unity. Again, the right-hand side term is due to creation or depletion of species i from the chemical reactions and $J_i^m$ is the diffusive mass flux vector that in this work is limited to Fickian diffusion, depends on the mass fraction gradient only, $$J_i^m=-\rho D_i\nabla Y_i,\ i=1,\ldots,N,$$

where $D_i$ is the species mixture-average diffusion coefficient in the mixture, which is calculated using $$D_i=\frac{1-Y_i}{\sum_{k\neq i}^{N}Y_k/\mathcal{D}_{ki}},\ i=1,\ldots,N,$$

Here, $D_{ki}$ are the binary diffusion coefficients of species k toward species i, computed using the approximation of Champan-Enskog. An additional mass flux $J_i^e$ is generated when an electric field is applied to the charged species that is determined by their electric mobility $\kappa$, which is given by $$J_i^e=s_i\rho\kappa_iY_iE,\ i=1,\ldots,N.$$

This term affects only the charged species, therefore $s_i=0$ for neutral species, −1 or +1 for negatively or positively charged species, respectively. There are no definitive expressions for the ionic mobility of the chemi-ions under consideration here, so the mobility of ions was considered to be $10^{-3}$ $V^{-1}$ $m^2$ $s^{-1}$ and the diffusion coefficients of ions is assumed to be equal to that of corresponding neutral species.

The energy conservation equation can be expressed in different forms in terms of enthalpy, internal energy, or temperature. In this study the energy equation is solved for the specific internal energy e of the mixture $$\nabla\cdot\left(\rho u\left(e+\frac{u\cdot u}{2}\right)+(pI-\tau)\cdot u+q\right)=0.$$

The mixture is assumed to be an ideal gas, with temperature-dependent mass-based specific internal energy e=e(T). The total heat flux q is calculated as $$q=-\lambda\nabla T+\sum_{i=1}^{N}h_i(J_i^m+J_i^e).$$

The first term of the heat flux originates from the Fourier's law, where $\lambda$ is the thermal conductivity and the second term describes energy flux due to the diffusive mass fluxes. $h_i$ is the mass-based specific enthalpy for species i.

Chemi-Ion Kinetics for $CH_4$/Air Combustion

In the modeling above, we have considered only three charged species: $HCO^+$, $H_3O^+$, and $e^-$, which have been shown in pre-existing literature to constitute a good representation of positively and negatively charged species in the gaseous medium. The three ionic reactions (I-III) were added to the chemical reaction mechanism, with the Arrhenius-kinetics parameters shown in Table 1. Chemi-ion generation did not provide feedback back to the kinetics of neutral species. The chemistry of charged species was first solved and then, chemi-ion concentrations were calculated using the parameters of Table 1.

TABLE 1

| Reactions involving chemi-ions | | | | |
|---|---|---|---|---|
| | | $k = AT^{\beta} \exp(-E_A/\Re T)$ | | |
| | Reaction | A [(m³/kmol)/(s K^β)] | β | $E_A$ [J/kmol] |
| I | $CH + O \rightleftharpoons HCO^+ + e^-$ | $2.52 \times 10^8$ | 0.0 | $7.11 \times 10^6$ |
| II | $HCO^+ + H_2O \rightleftharpoons CO + H_3O^+$ | $1.00 \times 10^3$ | −0.1 | 0.0 |
| III | $H_3O^+ + e^- \rightleftharpoons H_2O + H$ | $2.29 \times 10^{15}$ | −0.5 | 0.0 |

Computational Approach

Figure 3:
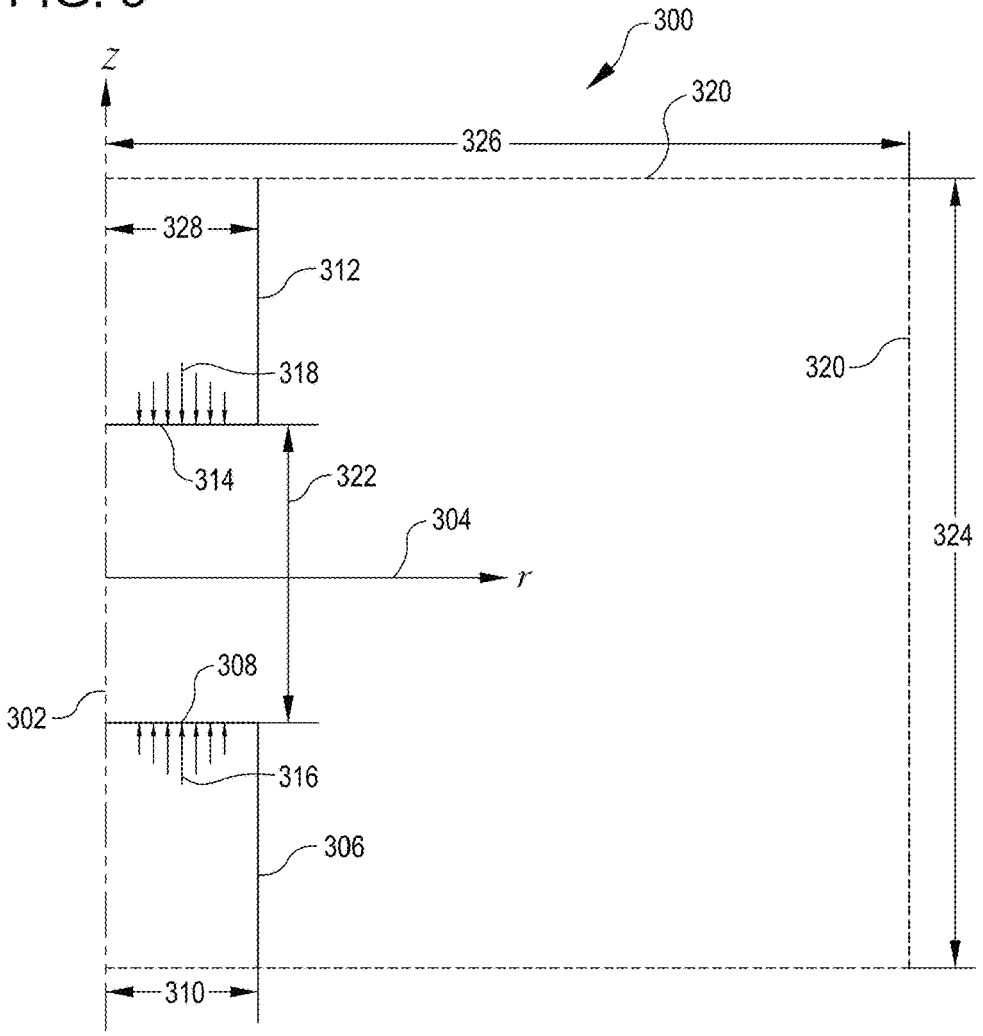
FIG. 3 shows a computational domain employed for predicting behavior of a counter-flow burner according to embodiments.

In order to obtain the steady structure of a non-premixed, counter-flow flames, a second-order integrating scheme using ANSYS-Fluent 16.0 was used. The computational domain 300 is shown in FIG. 3. Only half of the domain is used for a 2-D axisymmetric computation, as it is assumed symmetrical about a central axis 302. The computational domain 300 is bounded by a domain boundary 320 having a height 324 and a width 326 (both R=40 mm), and contains modeled surfaces representing a fuel mixture outlet 308 having a width 310 and sidewall 306, and an oxidizer outlet 314 having a width 328 and sidewall 312. The fuel mass flow 316 and oxidizer mass flow 318 enter perpendicular to a radial direction 304 and separated by distance 322. The outlet widths 310, 328 are L=15 mm, and the separation distance 322 is Z=20 mm.

The boundary conditions for the 2-D axisymmetric domain 300 are provided in Table 2. The velocity at the exit of the nozzles is uniform. Also, the wall of the oxidizer nozzle is kept at low temperature (300 K), since in the experimental burner the oxidizer nozzle is cooled by water. The electric field in the computation domain is applied only in the axial direction.

TABLE 2

| Boundary conditions for the computation. | | | | |
|---|---|---|---|---|
| | T | $u_z$ | $u_r$ | $Y_i$ |
| Axisymmetric line (r = 0) | $\frac{\partial T}{\partial r} = 0$ | $\frac{\partial u_z}{\partial r} = 0$ | $\frac{\partial u_r}{\partial r} = 0$ | $\frac{\partial Y_i}{\partial r} = 0$ |
| Outer Zone (r = R) and (z = ±Z), (L/2 < r < R) | $\frac{\partial T}{\partial r} = 0;$ | $\frac{\partial u_z}{\partial r} = 0;$ | $\frac{\partial u_r}{\partial r} = 0;$ | $\frac{\partial Y_i}{\partial r} = 0;$ |
| | $\frac{\partial T}{\partial z} = 0$ | $\frac{\partial u_z}{\partial z} = 0$ | $\frac{\partial u_r}{\partial z} = 0$ | $\frac{\partial Y_i}{\partial z} = 0$ |
| Oxidizer Inlet (z = +L/2), (0 < r < R) | $T_0$ | $-u_{z,0,oxy}$ | 0 | $Y_i = 0;$ $i \neq O_2, N_2$ |
| Fuel Inlet (z = +L/2), (0 < r < R) | $T_0$ | $u_{z,0,fuel}$ | 0 | $Y_i = 0;$ $i \neq CH_4,$ |

The detailed GRI-Mech 3.0 mechanism (Smith, G. P., Golden, D. M., Frenklach, M., Moriarty, N. W., Eiteneer, B., Goldenberg, M., Bowman, C. T., Hanson, R. K., Song, S., Gardiner, W. C., Jr., Lissianski, V. V., and Qin, Z. http://www.me.berkeley.edu/gri_mech/, 1999) was used in order to model the kinetics. This mechanism uses 53 neutral species, to which the three chemi-ions $HCO^+$, $H_3O^+$ and $e^-$ were added as per the analysis above in order to ultimately have N=53+3=56 species and 325 reactions among neutral species, to which three reactions including chemi-ions were added in order to ultimately have J=325+3=328 reversible reactions. The reaction mechanism used in the simulation is listed in the Appendix. In this work, the computational domain has been discretized using 140775 nodes via employing a uniform grid of size $1\times10^{-4}$ m. A 24-core, 2.7 GHz Hewlett-Packard computer was used in order to perform the necessary computations.

Flame morphology was studied in terms of a set of three parameters:

1. Overall strain rate of the flame (K). This was controlled by the mass flow rates of the counter-flowing streams; it essentially determines the Damköhler number and controls extinction for steady flames like the one at hand.

2. Overall mixture strength/equivalence ratio (φ). This depends on the mass flow rates of fuel and oxidizer and determines the relative position of the non-premixed flame sheet and the stagnation plane in the counter-flow flame.

3. Electric field (E). This is viewed as an independent way to control flame morphology that does not depend on the mechanical/chemical properties of strain and overall mixture strength. In this manner, we checked the hypothesis that the flame can be positioned in a manner that can be varied through electrostatics, even for constant overall strain rate and mixture strength.

These three parameters were controlled as follows: From the mass flow rates of the mixture components at each nozzle, the molecular mass of the mixture was calculated as:

$$M_{mix} = \frac{1}{\sum_{k=1}^{n} \frac{y_k}{M_k}}$$

Where $y_k$ and $M_k$ are the mass fraction and molecular mass of species k. The mass flow rate of each gas is metered independently, therefore the mass fraction $y_k$ of each gas is known. The density of the ideal gas under ambient conditions of room temperature T and atmospheric Pressure $P_{atm}$ was then calculated as:

$$\rho_n = \frac{PM_{mix,n}}{\bar{R}T_n}$$

Where the subscript n could indicate either the fuel or the oxidizer stream (n=oxy or fuel) and $\bar{R}$ is the universal gas constant. Once the density is known, the speed $V_n$ of each flow stream at the exit nozzle with a certain area A is calculated:

$$V_n = \frac{\dot{m}_{tot,n}}{\rho_n A}$$

Finally the strain rate K at the stoichiometric surface (where the flame sits) is estimated using the approximation (Seshadri and Williams 1978):

$$K = \frac{2V_{ox}}{d}\left[1 + \frac{V_{fuel}}{V_{oxy}}\left(\frac{\rho_{fuel}}{\rho_{oxy}}\right)^{\frac{1}{2}}\right]$$

The overall equivalence ratio φ is calculated from the mass flow rates of the fuel and the oxidizer:

$$\varphi = \frac{(F/O)}{(F/O)_{stoich}}$$

Where (F/0) is the Fuel to oxidizer ratio and $(F/O)_{stoich}$ the stoichiometric ratio.

As for the electric field, this was controlled by the applying a potential difference Δφ between the two parallel plates that were separated by the distance l and calculating an "average" field strength as:

$$E = \frac{\Delta\phi}{l}$$

In this manner the effect of the dilute plasma that the chemi-ions generate on the local electric field is neglected, which is a reasonable approximation given that the overall degree of ionization caused by the chemi-ions is expected to be small (Belhi et al., 2010).

The effect of the application of a DC electrostatic field on the behavior of the non-premixed laminar flame is shown schematically in FIGS. 4A-4G for a $N_2$-diluted, non-premixed, methane-oxygen flame with an overall equivalence ratio of φ=0.64 that sustains a strain rate of K=143 $s^{-1}$. Direct photographs from the digital camera were captured for the variation of the flame behavior with the applied voltage, as shown in FIGS. 4A-4G.

FIGS. 4A-4G show multiple examples of flame behavior in a counter-flow burner such as burner 100 as shown in FIGS. 1 and 2, as a function of applied voltage for an overall equivalence ratio of φ=0.64 that sustains a strain rate of K=143 $s^{-1}$. The signal corresponds to visible flame luminosity. The geometry of the burner is described in FIG. 4D where the positions of both nozzles 134 (oxidizer), 164 (fuel) and both upper and lower electrodes 142, 180 are shown. The direction of the electric field is assumed to be positive in the "upper" direction (i.e. the one opposing gravity), which is achieved when the upper electrode 142 is negatively charged. The values next to the images represent the voltage applied to the bottom plate. Therefore, the first three images, FIGS. 4A-4C were taken with the electric field is directed upwards. The poles were reversed for the last three images, FIGS. 4E-G. Also, one image FIG. 4D was taken without any electric field.

Figure 4A:
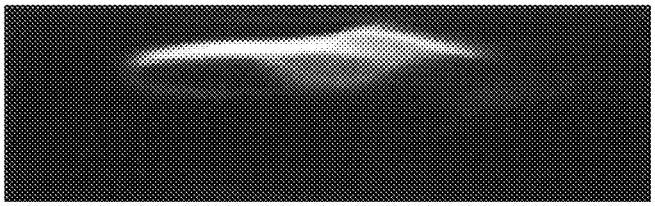
FIGS. 4A-4G show multiple examples of flame behavior in a counter-flow burner as a function of applied voltage for an overall equivalence ratio of $\varphi=0.64$ that sustains a strain rate of $K=143\ s^{-1}$.
Figure 4B:
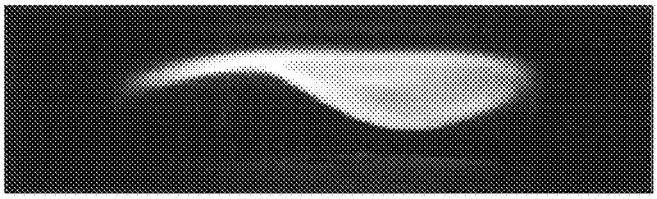
Figure 4C:
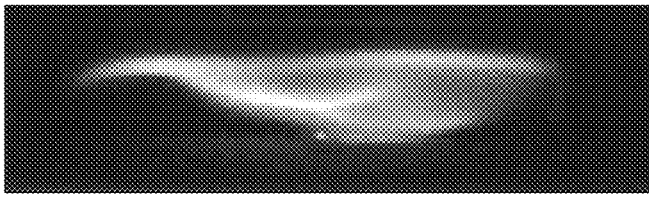
Figure 4D:
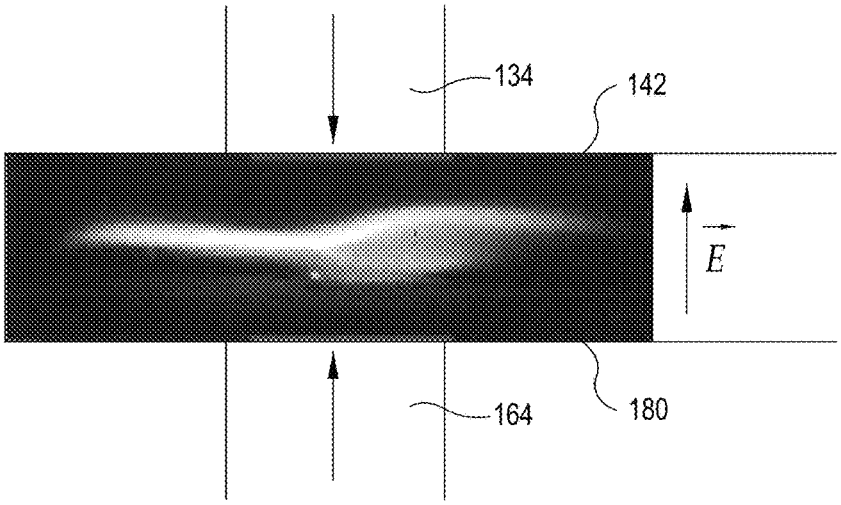

As shown in FIG. 4D, without applying any electric field, the flame 408 was stabilized almost in the center between the two electrodes 142, 180 which are separated by approximately 2 cm. When the electric field was applied, the flame morphology and location changed dramatically. This allowed steering the flame up and down by controlling the voltage applied and/or inversing polarity. In all cases the flame was attracted to the negative plate, which implies that the flame behaves as electrostatically positive. This is in agreement with suggestions that have been made that, since the negative charge carriers are much more mobile they rapidly move away from the flame (Yamashita et al., 2009). However, our finding is interestingly different from the results of Anderson et al. (2008), who showed that non-premixed flames developing around charged droplets are attracted to the droplet when the droplet is positive. The explanation probably lies in the fact that in a liquid-fuel flame substantial amounts of soot are formed, unlike in the methane flames under consideration here. The mobile electrons end up in the soot particles which then become negatively charged. The response of the flame to the electric field is then dominated by the negative soot particles as opposed to the positive chemi-ions, which have relatively negligible inertia. This is an important consideration, as application of the technology is considered for both gaseous and liquid fuels.

Figure 4E:
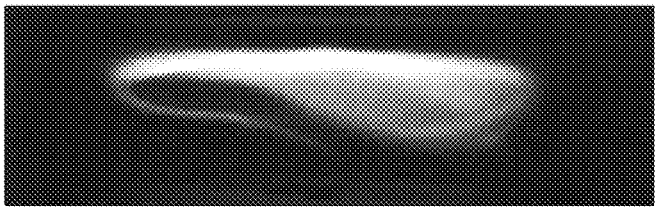
Figure 4F:
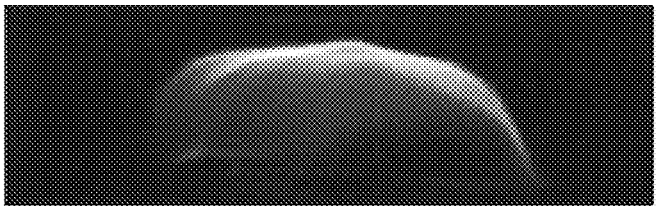
Figure 4G:
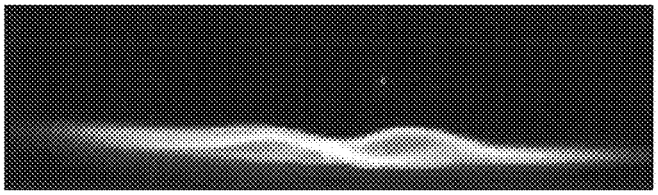

The important finding of the study of flame morphology is salient: The position of the flame in the mixing layer can be controlled by electrostatics, without any variation of the chemical/mechanical characteristics of the flame. FIGS. 4A-4D clearly show that by varying the electric field, the flame can be positioned pretty much at any location in the gap between the two nozzles 134, 164 for a given overall mixture strength and imposed strain rate. For example, flames 402, 404, and 406 are shown at varying heights between the nozzles 134, 164 approaching the positive electrode 142 (FIGS. 4A-4C). Similarly, flames 410, 412, and 414 are shown approaching the lower electrode 180 (FIGS. 4E-4G). The location of the flame is not necessarily in the stoichiometric surface as demanded by the classical analysis of non-premixed flames.

Figure 5:
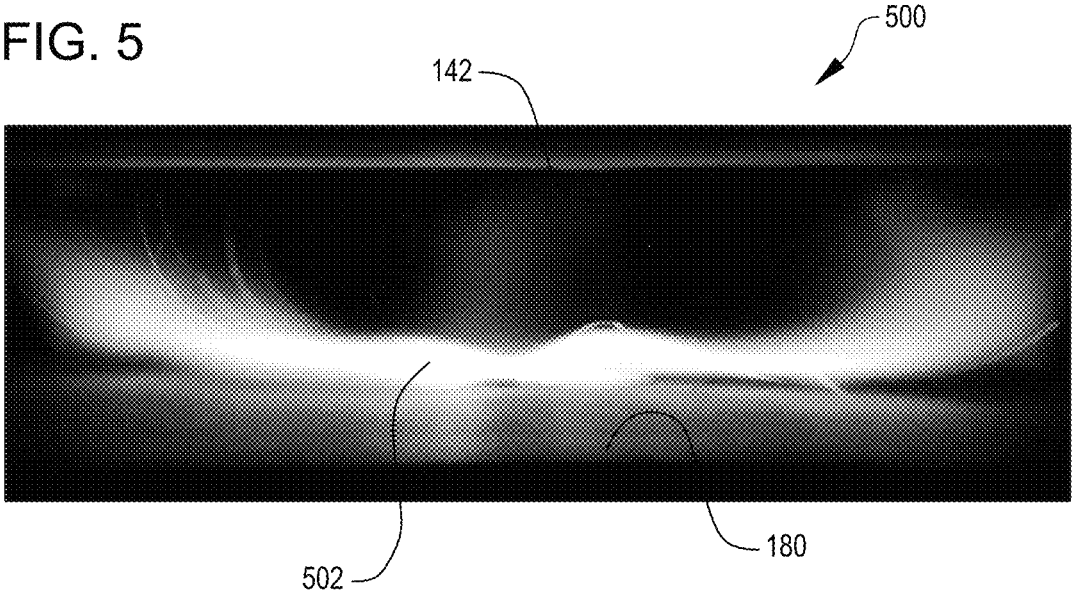
FIG. 5 shows a flame attached to a fuel nozzle of a counter-flow burner through the action of the electrostatic field.

Notably, as the voltage reached −3 kV, the electrostatic force was capable to attract the flame completely to the side of the negative plate without extinction. It is remarkable that electrostatics seems to be able to "push" the flame to a location where there is seemingly very little oxidizer! This is potentially very interesting for practical applications, where intense heat transfer to a solid surface is necessary, as FIG. 5 shows, which a continuation of FIG. 4G for −4 kV. In this case, the flame touches the negatively charged plate at a high voltage, and the blue luminosity of the flame changes to a strong red color, most probably because of incandescent metal particles and impurities.

An interesting interaction of the electrostatic effect with buoyancy is also evident. For example, the flame is attracted to the negative electrode in a manner that starts from the edges, thus forming a "dome"-shaped flame (FIG. 4F), before "collapsing" on the negative electrode (FIG. 4G). It is also conceivable that the concentration of charged species is higher at the edges, because the one-dimensionality of the flame is not valid near its shroud.

It is also noted that the morphology of the flame is not symmetric with respect to polarity. The "dome"-shape flame of FIG. 4F is very closely symmetric unlike image the flame of FIG. 4B, which corresponds to a voltage of equal magnitude but reversed polarity and has an asymmetric shape. As the voltage is increased to +3 kV, an unstable behavior of flame is observed (FIG. 4A) contrary to the flame of FIG. 4G, which is stable.

Figure 6A:
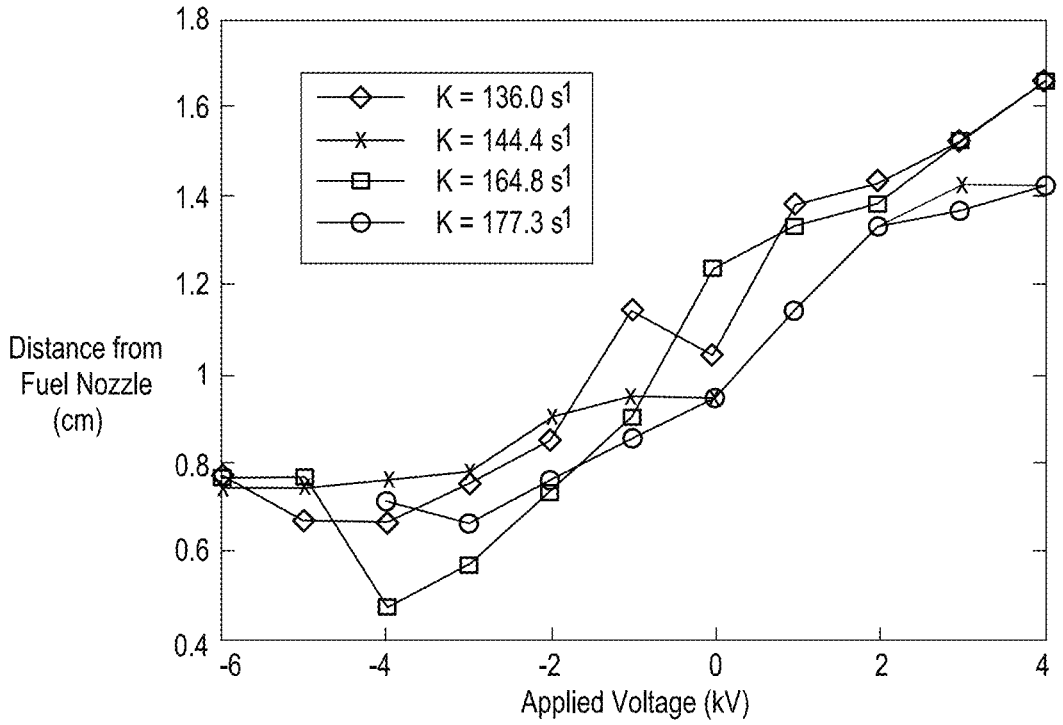
FIG. 6A shows flame location as a function of applied voltage for a constant overall equivalent ratio of 1.0 and varying strain rate.
Figure 6B:
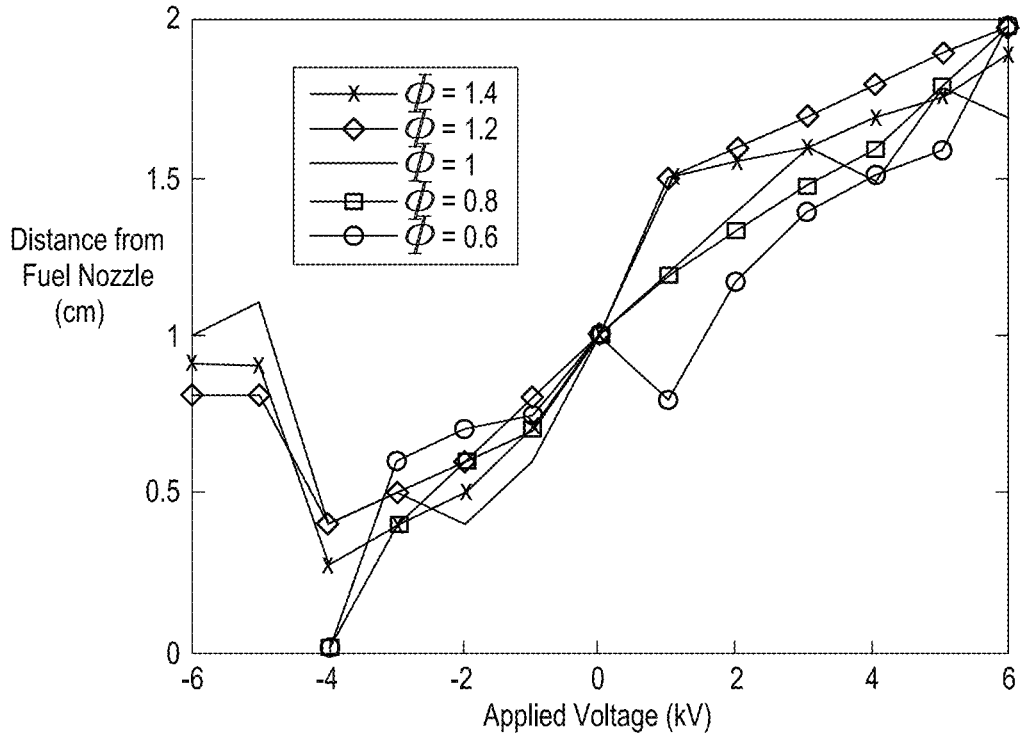
FIG. 6B shows flame location as a function of applied voltage for a constant strain rate of $190\ s^{-1}$ and varying overall equivalent ratio.

The capability to control flame position through electrostatic action, without any real reference to the chemical and mechanical characteristics of the flame is quantitatively demonstrated in FIGS. 6A-6B, which shows the position of the flame from the fuel nozzle as a function of the applied voltage. Due to the curvature of the flame, the mean flame position was computed as the weighted average of the distance from the nozzle exit and the corresponding luminosity. In particular, the location of the flame is recorded as a function of applied voltage for a constant overall equivalent ratio of 1.0 and varying strain rate (FIG. 6A) and for a constant strain rate of 190 $s^{-1}$ and varying overall equivalent ratio (FIG. 6B). Only the mass flow rates of nitrogen were varied in order to obtain different strain rates. The main conclusion from this data is clearly that the determining factor for flame location is applied voltage. There is no discernable systematic difference on either strain rate or overall equivalence ratio. Similarly to the data of FIGS. 4A-4G, strong negative charging practically "pushes" the flame towards the fuel nozzle. In FIG. 6A, it can be seen that for an overall equivalent ratio of 1.0, the distance of the flame from the oxidizer nozzle "flattens" to approximately 0.6-0.8 cm from the fuel nozzle for negative charges larger (in absolute value) than 2 kV. FIG. 6B contains an important influence of overall equivalence ratio: For lean flame and when the voltage applied is −4 kV the flame is completely attracted to the bottom electrode and therefore extinguishes. This is not observed for "richer" overall mixture compositions, for which there seems to even be a slight "repulsion" from the fuel nozzle as the negative voltage increases, possibly because of oxidizer deficiency.

Computational Results

Figure 7:
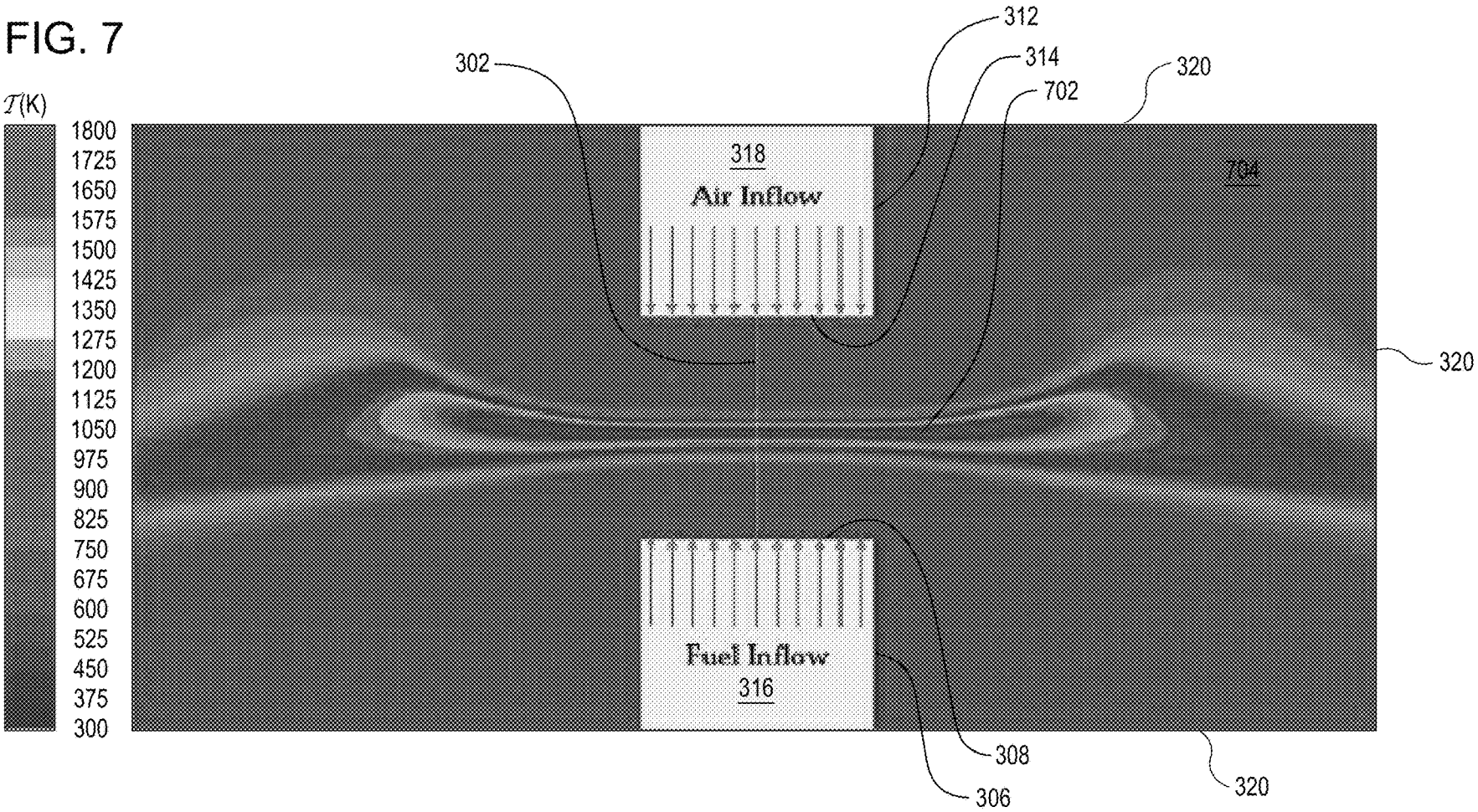
FIG. 7 shows a modeled contour of temperature of a modeled flame in a counter-flow burner using the detailed chemical mechanism GRI 3.0.

The detailed chemical mechanism GRI-Mech 3.0 was used to compute the flame structure in the computational domain 704, which is similar to the half computational domain 300 shown in FIG. 3. The two-dimensional structure of the flame 702 is shown in FIG. 7, which reports the results of the two-dimensional computation of temperature. The results correspond to a flame at atmospheric pressure with $u_{ox}$=50 cm/s, $T_{ox}$=300 K, and $Y_{O2}$=0.23 which is equivalent of mass flux of 0.586 $kg \cdot m^{-2} \cdot s^{-1}$ at the oxidizer nozzle 314 and $u_{fuel}$=50 cm/s, $T_{fuel}$=300 K and $Y_{CH4}$=0.50 that is equivalent to 0.326 $kg \cdot m^{-2} \cdot s^{-1}$ at the fuel nozzle 308. The results are in agreement with theoretical expectations for a thin high-temperature zone in the gap between the two nozzles and then thick high temperature zones in locations where the strain is smaller.

Figure 8:
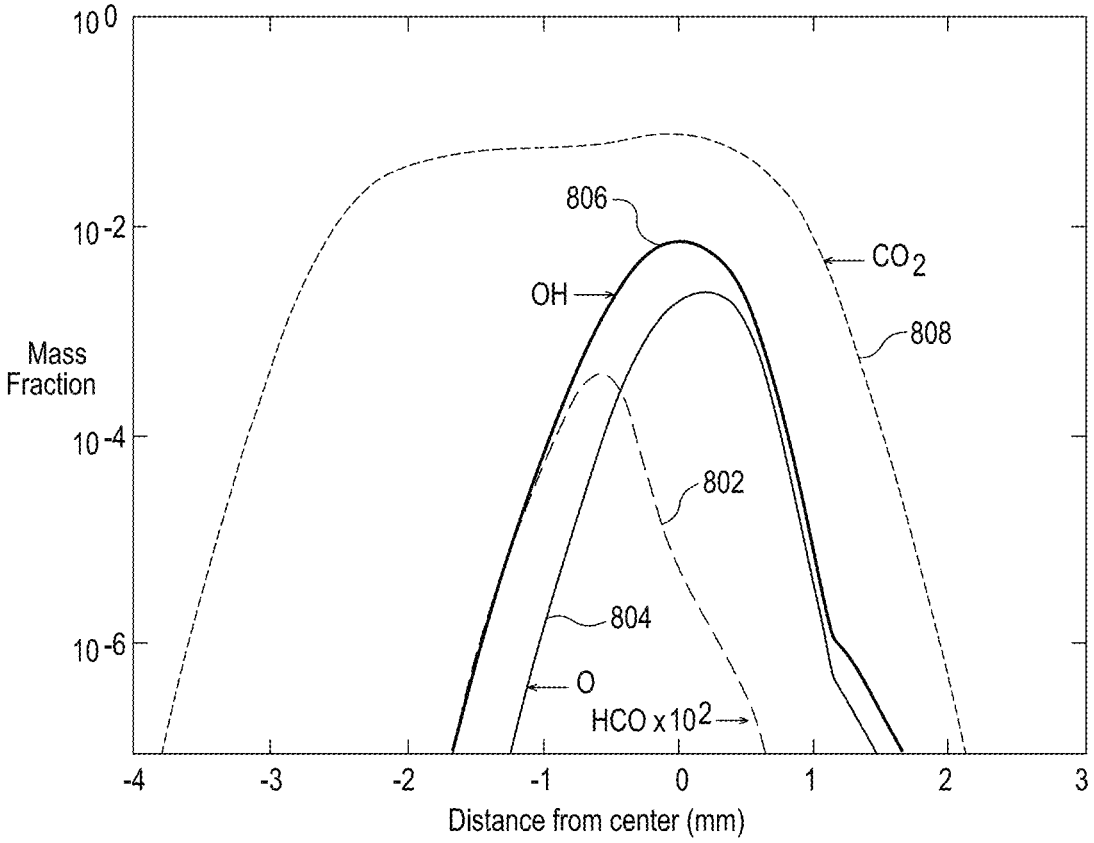
FIG. 8 shows a mass fraction profile of OH, $CO_2$, O and HCO as a function of location along a flame centerline in a counter-flow burner.
Figure 9:
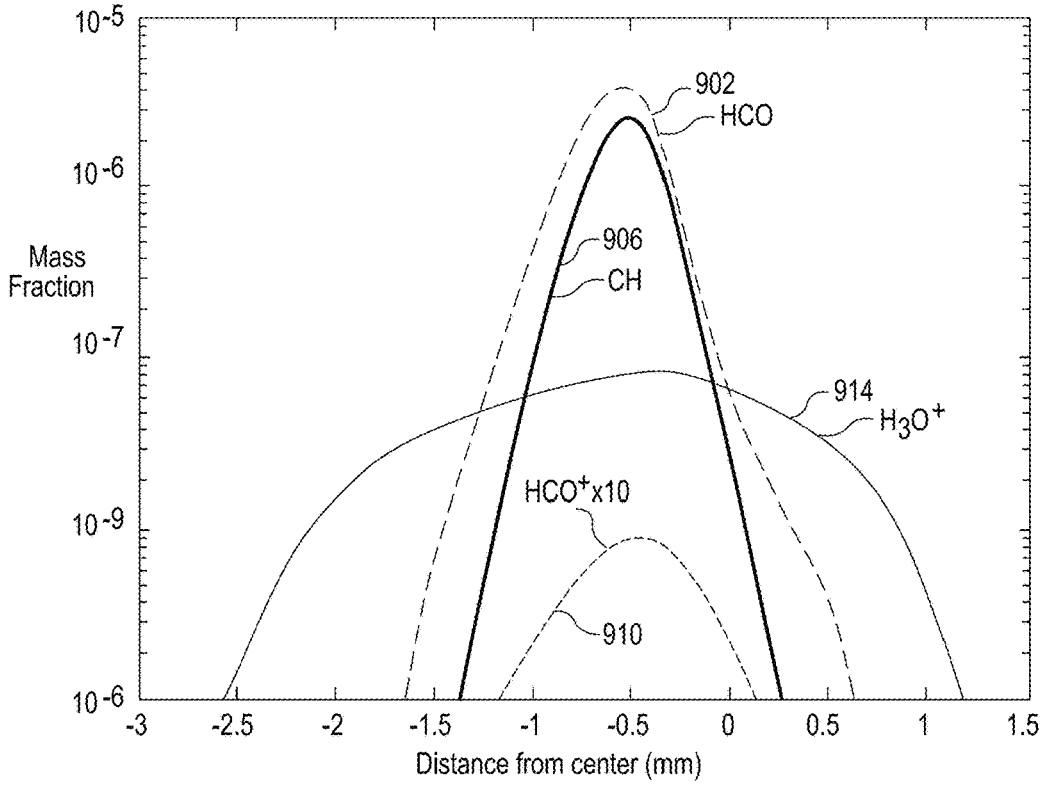
FIG. 9 shows a mass fraction profile of HCO, $HCO^+$, CH and $H_3O^+$ as a function of location along a flame centerline in a counter-flow burner.

More results showing the charged species on flame structure are provided in FIGS. 8 and 9. The distributions of mass fractions of indicative major species of the neutral-species kinetics like CO2 (808), and OH (806) along the centerline are shown in FIG. 8 for a computation in which no electric field was applied. FIG. 9 provides the mass fractions of the two cations ($H_3O^+$ (914) and $HCO^+$ (910)) that were used in the model. HCO mass fraction (802, 902) is provided in both figures for reference. Also, because of their important role as "sources" of the chemi-ions (as per reaction I of Table 1), O and CH (804, 902) mass fractions are reported in FIGS. 8 and 9. Part of the CH molecules (determined by the local temperature) will be at an electronically excited state, the relaxation of which causes the chemiluminescence that was recorded in the experiments, so the distribution of CH correlates with the luminous region of the flame that is recorded in the experiments. It is noted that the dominant charged species $H_3O^+$ is relatively stable and diffuses in significantly larger area than the luminous zone of the flame. $HCO^+$ on the other hand is very reactive and short-lived and exists in very small quantities in a narrow region of the flame.

Figure 10:
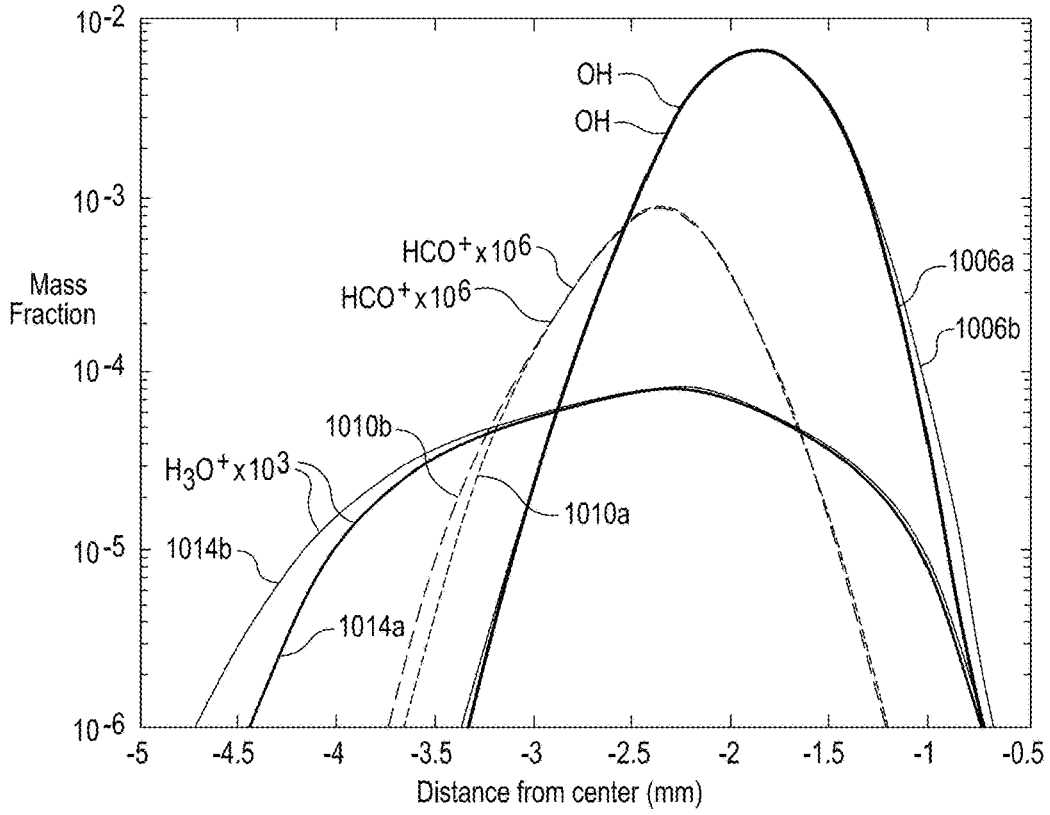
FIG. 10 shows mass fraction profiles of OH, $H_3O+$, and OH as a function of location along a flame centerline in a counter-flow burner showing concentrations computed both with and without ambipolar diffusion.

As discussed above, the electric field affects the reactive flow in two distinct ways: First, it generates the body force Se that affects the momentum balance. Then it introduces an additional form of diffusive mass flux $J_e^i$, the so-called ambipolar diffusion. The results shown in FIG. 10 were computed using the equation of momentum with the electric body force Se that is caused by applying 5 kV in a direction toward the fuel nozzle (downward direction) and the equation of species evolution with and without ambipolar diffusion flux $J_e^i$. We compared the relative importance of these two terms by running a computation using equation of species evolution with and without the ambipolar diffusion flux term $J_e^i$. As FIG. 10 shows, the effect of ambipolar diffusion is minor, because its introduction changes the results very little. For example, mass fractions with and without the ambipolar flux term of OH (1006*a, b*, respectively), $HCO^+$ (1010*a, b*), and $H_3O^+$ (1014*a, b*) are shown, with very little difference between the respective curves of each. We were able to also establish that omission of the ambipolar diffusion terms from the energy balance has no discernable effect on flame structure either.

Comparison of Experimental with Computational Results

Figure 11:
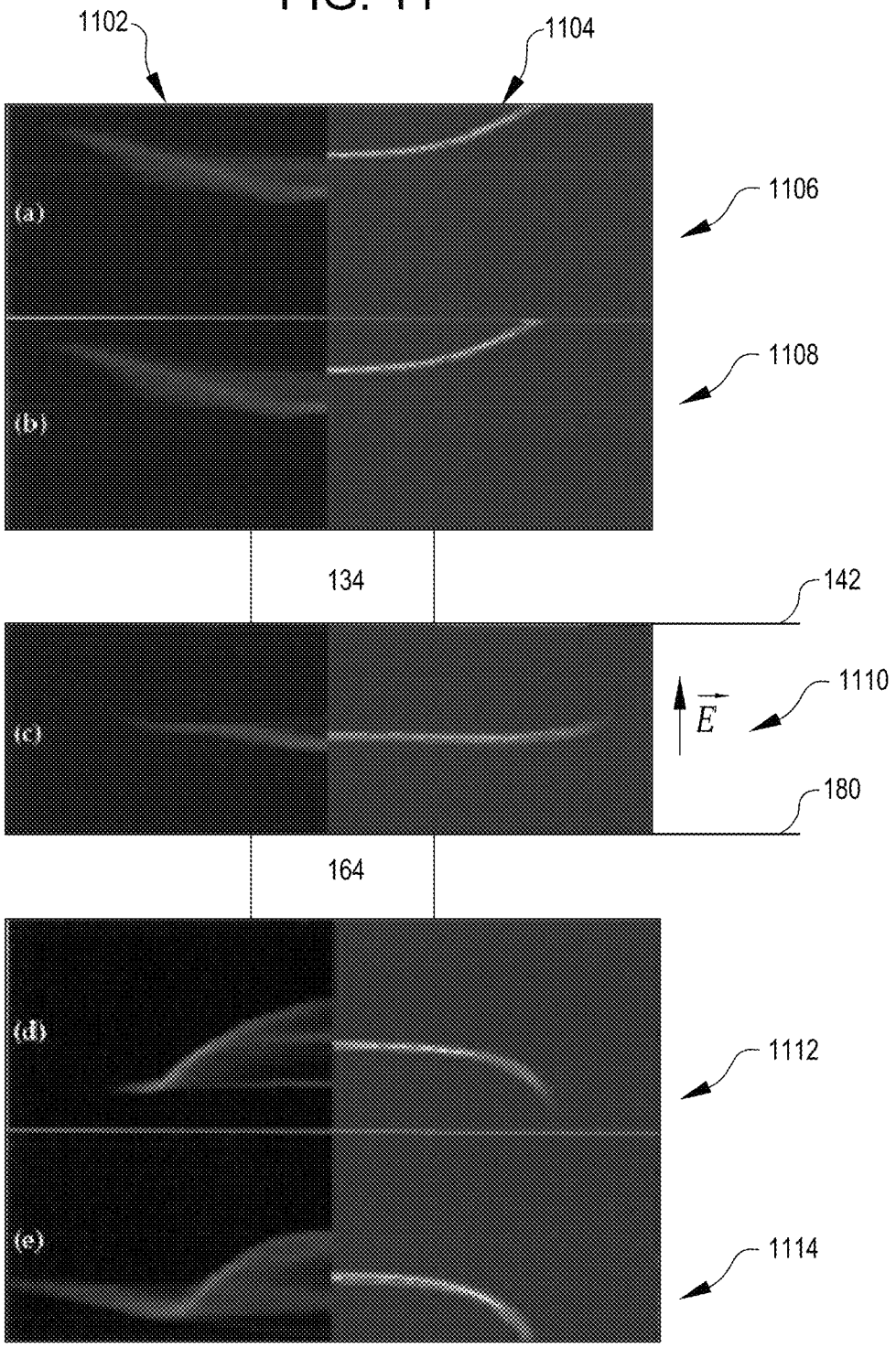
FIG. 11 shows chemiluminescence signals from the flame in a counter-flow burner (left images) and computed distribution of HCO (right images) for several values of applied voltage.

The effect of the application of a uniform electric field on the structure of the non-premixed laminar flame is shown in FIG. 11, where experimental and computational results are compared. In particular, images of chemiluminescence of the flame (on the left side 1102 of the panels of FIG. 11) are compared with computed distributions of HCO mass fraction (which has been suggested as an observable of the high-heat-release zone in the flame) (on the right side 1104 of the panels of FIG. 11) for varying intensity of the applied field. Similarly to FIGS. 4A-4D, the positions of the oxidizer and fuel nozzles 134, 164 are shown in FIG. 11. The direction of the electric field is assumed to be positive in the "upper" direction, which is achieved when the upper electrode 142 is negatively charged and/or the lower electrode 180 is positively charged. Panel 1110 corresponds to a flame without electric field. The first two panels (panels 1106, 1108) are with the electric field "upwards" at, e.g. 5 kV (1106) and 2.5 kV (1108). Then, the poles were reversed for the last two panels (panels 1112, 1114) with the electric field "downwards" at, e.g., −2.5 kV (1112) and −5 kV (1114).

FIG. 11 shows that flame morphology is captured with good agreement between experiments and computations. It is noted that the experimental data are images with a finite depth of field of view. In several occasions, this reveals instability of the flame. Notably, when the flame is "pushed" by the electric field towards the fuel nozzle, it develops instability. On the other hand, flames that are "pushed" by the electric field towards the oxidizer nozzle are stable. This instability was not captured by our computations and an investigation of its causes was beyond our scope.

When the flame is ignited and no electric field is applied, the flame stabilizes almost in the middle between the two nozzles. The applied voltage affects position and morphology dramatically. It is noted that, without changing any of the mechanical and chemical characteristics of the flame (speed at the nozzles, mass fractions of methane, oxygen, and nitrogen etc.) we are able to position the flame at practically any location in the gap between the two nozzles just by controlling electric field intensity and direction. The flame was attracted to the negative plate in all cases, which indicates that the flame acts as electrostatically positive. This indicates that the majority of the charged species are positively charged and it agrees with the assumption that the electrons have a very large diffusion coefficient and leave the flame region fast. It is noted that our finding is interestingly different from results previously reported by the PI, where flames around charged droplets were shown to be attracted to the droplet when the droplet was positive. This was probably due to the existence of soot particles in the droplet flame, where electrons arrived thus generating a collection of heavy, negatively charged particles that determined the response when the electric field was applied.

Figure 12:
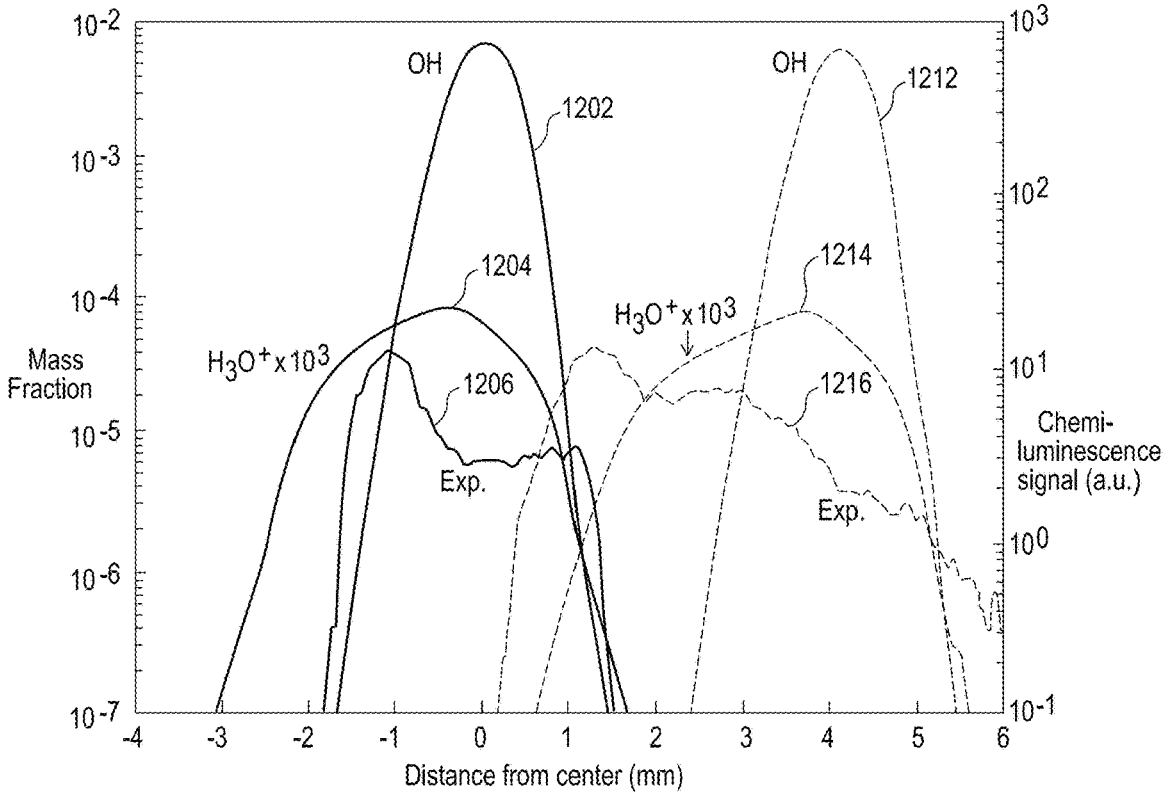
FIG. 12 shows computed $H_3O^+$ and OH mass fraction distributions and experimental chemiluminescence signals at the flame centerline (z=0) of data from the case of 0 kV (leftmost curves) and the case of 5 kV (rightmost curves)

The effect of application of the electric field is further studied in FIG. 12, which shows the computed distributions of OH (1202, 1212) and $H_3O^+$ (1204, 1214) along with the chemiluminescence signal recorded from the flame (1206, 1216) along the centerline for two flames: One without electric field (FIG. 11, panel 1110) and one with 5 kV (FIG. 11, panel 1106). Distributions centering around a distance of zero (e.g. 1202, 1204, 1206) are associated with the absence of an electric field, and the distributions centering on a positive distance from center (e.g. 1212, 1214, and 1216) are associated with the electric field of 5 kV.

The motion of the flame that is caused by the application of a voltage of 5 kV seems to be slightly larger in the computations that in the experiments, which is in agreement with FIG. 11, panel 1106 and is probably due to a slight wrinkling of the flames in the experiments. However, both experiments and computations tend to indicate the following very interesting fact: The application of the voltage seems to simply shift the flame without change in its structure. Electrostatics seem to act in a way that does not affect the structure of convection-, diffusion-, and chemical-reaction balance that exists in the flame, it simply moves the flame closer to one of the nozzles. This may be of substantial practical importance because it indicates that it may be possible to attract a flame to a heat transfer surface without altering its structure, using electrostatic manipulation.

Potential Applications

It has been shown that the chemi-ions contained in the flames generated by logistic fuels generate a dilute plasma that can be manipulated by electric fields (on the order of intensity of 100-1000 V/mm) in a manner that allows positioning the flame virtually on top of solid surfaces from which the fuel is injected. Contrary to what happens in classical fuel injection, the flame is not a corrugated surface the exact location of which is dictated by turbulent mixing of the reactants but rather a heat-releasing sheet that sits on top of the solid surface. It is noted that the need for mixing to occur means that classical burners that are used for heat generation have to be spacious exactly in order to allow for the mixing to happen. The proposed technology alleviates this caveat. Through electrostatics, it is possible to exert a force on the flame and attach it to solid surfaces, as shown in, e.g. FIGS. 4A-4G and FIG. 5. In practical applications, a simple fan can provide an oxidizer stream, e.g. by directing a flow of gas containing oxygen, such as air which may or may not be enriched with additional oxygen. This technology can make burners compact and may generate the technological possibility of "flame panels", i.e. solid panels with flames attached on them in the fashion of FIG. 5 that can be used as a source of intense heat generation for a series of industrial applications such power generation and chemical processes.

Preliminary Model

The effect of electrostatics on flame structure was initially modeled as described below. A flame system can be modeled as steady, compressible and laminar reacting flow of density ρ and velocity components in axial $u_z$ and radial $u_r$ directions. The description of the problem is governed by the conservation equations in a cylindrical coordinates where z and r represent axial and radial coordinates, respectively. It is stressed that the purpose of these introductory computations was not to introduce electrostatics in the reactive Navier-Stokes, but rather to establish an easy-to-use computational tool and characterize its accuracy against previous detailed studies of the particular flames.

The mass continuity and momentum equations that were solved by the code can be written as follows:

Mass:

$$\frac{\partial(\rho u_z)}{\partial z}+\frac{1}{r}\frac{\partial(r\rho u_r)}{\partial r}=0$$

Momentum (z):

$$\frac{\partial(\rho u_z u_z)}{\partial z}+\frac{1}{r}\frac{\partial(r\rho u_r u_z)}{\partial r}=-\frac{\partial P}{\partial z}$$

Momentum (r):

$$\frac{\partial(\rho u_z u_r)}{\partial z}+\frac{1}{r}\frac{\partial(r\rho u_r u_r)}{\partial r}=-\frac{\partial P}{\partial r}$$

Where P is the pressure that is calculated by the ideal gas law. The transport equation for evolution of chemical species $X_k$ (mass fraction), $Y_k$ (mole fraction), k=1, 2, . . . n, in the flame is:

$$\rho u_z\frac{\partial Y_k}{\partial z}+\rho u_r\frac{\partial Y_k}{\partial z}=-\frac{\partial}{\partial z}(\rho V_k Y_k)-\frac{1}{r}\frac{\partial}{\partial r}(r\rho V_k Y_k)+M_k\dot{\omega}_k$$

$$V_k=-\frac{1}{X_k}D_{km}\nabla X_k$$

$V_k$ is the diffusion velocity, the index m in the diffusion coefficient $D_{km}$, indicates a different species m diffuses into species k which was calculated using the Maxwell-Stefan model; $M_k$ is the molecular mass of a single species and $\dot{\omega}_k$ represent its molar production rate per unit volume through chemical reaction.

The energy equation is:

$$\rho u_z\frac{\partial(C_v T)}{\partial z}+\rho u_r\frac{\partial(C_v T)}{\partial r}=-\frac{\partial}{\partial z}\left(\rho\sum_{k=1}^{n}h_k V_k Y_k\right)-$$

$$\frac{1}{r}\frac{\partial}{\partial r}\left(r\rho\sum_{k=1}^{n}h_k V_k Y_k\right)+\frac{\partial}{\partial z}\left(\lambda\frac{\partial T}{\partial z}\right)+\frac{1}{r}\frac{\partial}{\partial r}\left(r\lambda\frac{\partial T}{\partial r}\right)-\sum_{k=1}^{n}M_k\dot{\omega}h_k^o$$

In this equation T denotes the temperature, $h_k^o$ is the specific enthalpy of formation of species k, $h_k$ is the specific enthalpy of species navier stroke, $C_v$ is the specific heat under constant volume of the gaseous mixture and λ its thermal conductivity.

The boundary conditions for the computation are listed below in Table 3.

TABLE 3

Boundary conditions for the Preliminary Model

| | $Y^k$ | $u_r$ | $u_z$ | T |
|---|---|---|---|---|
| Fuel inlet | $Y_{CH_4}$, $Y_{N_2}$ | | | |
| $\left(z = -\frac{L}{2}\text{mm}\right)$, | $Y^k = 0$; | 0 | $u_{z0,f}$ | $T_0$ |
| $(0 < r < R)$ Air Inlet | $k \neq CH_4, N_2$ $Y_{O_2}$, $Y_{n_2}$ | | | |
| $\left(z = +\frac{L}{2}\text{mm}\right)$, | $Y^k = 0$; | 0 | $-u_{z0,a}$ | $T_0$ |
| $(0 < r < R)$ | $k \neq O_2, N_2$ | | | |
| Axis of Symmetry $(r = 0)$ | $\frac{\partial Y^k}{\partial r} = 0$ | $\frac{\partial u_r}{\partial r} = 0$ | $\frac{\partial u_z}{\partial r} = 0$ | $\frac{\partial T}{\partial r} = 0$ |
| Outer zone | $\frac{\partial Y^k}{\partial r} = \frac{\partial Y^k}{\partial z} = 0$ | $\frac{\partial u_r}{\partial r} = \frac{\partial u_r}{\partial z} = 0$ | $\frac{\partial u_z}{\partial r} = \frac{\partial u_z}{\partial z} = 0$ | $\frac{\partial T}{\partial r} = \frac{\partial T}{\partial z} = 0$ |

In order to calculate flame chemistry, the detailed GRI 3.0 $CH_4$-air mechanism (Smith et al.) was imported to FLUENT, which contained 53 species that underwent 325 reactions. A uniform grid size of $\Delta x = 1 \times 10^{-5}$ m is used to for the computational.

Verification of the Preliminary Model

An ANSYS-Fluent-based computational model was developed for the study of the experimentally observed flames by coupling the code with detailed kinetics and verifying against the computational results of Smooke et al. (1986) which calculated a flame without electrostatic manipulation. The same chemical kinetic schemes and boundary conditions were used in both computations. In the computation of Smooke et al., the fuel was introduced through a stream that extended infinitely and had with a mass flux of $2.40 \cdot 10^{-2}$ g/cm$^2$·s, which was emulated in the nozzle of the experimental burner. The mass fraction of fuel and diluent were $Y_{CH4}$=0.598 & $Y_{N_2}$=0.402 respectively. In the opposing nozzle, the oxidizer was introduced with a mass flux of $6.06 \cdot 10^{-2}$ g/cm$^2$·s and mass fractions of $Y_{O2}$=0.18 & $Y_{N_2}$=0.402.

Figure 13:
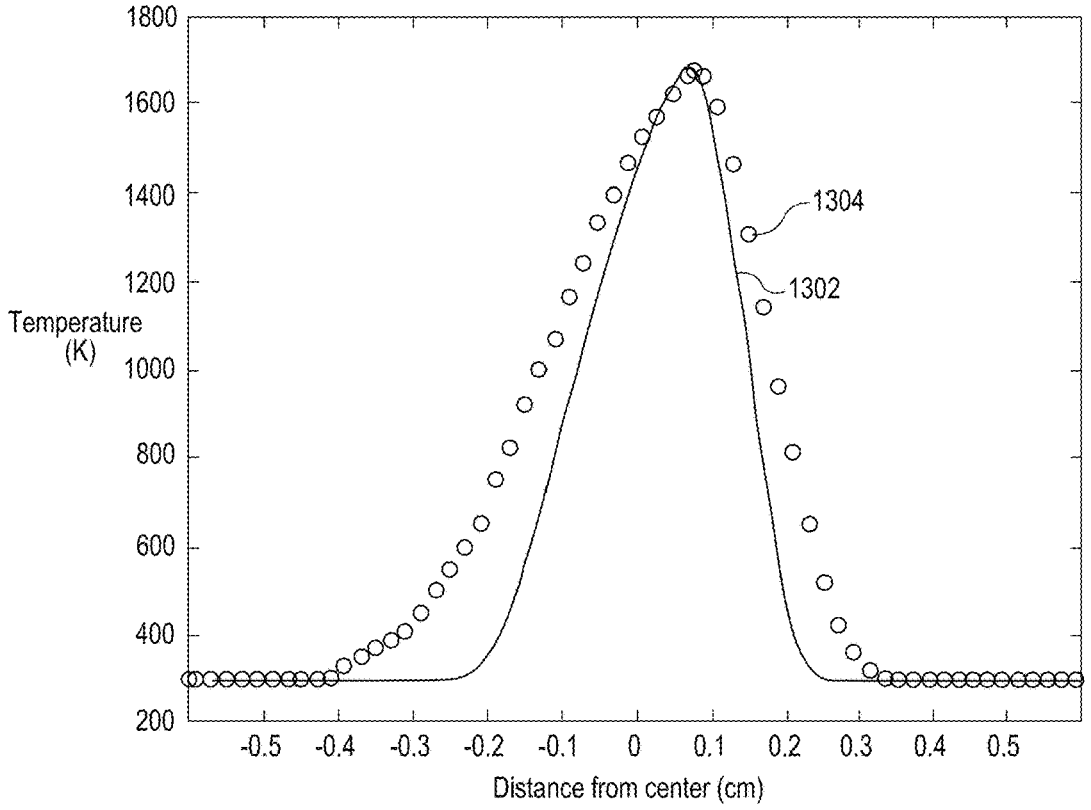
FIG. 13 shows a temperature profile for a N2-diluted, $CH_4$-oxygen, counter-flow, non-premixed flame at the flame centerline (z=0), with data from Smooke et al. compared with the computationally obtained data.
Figure 14:
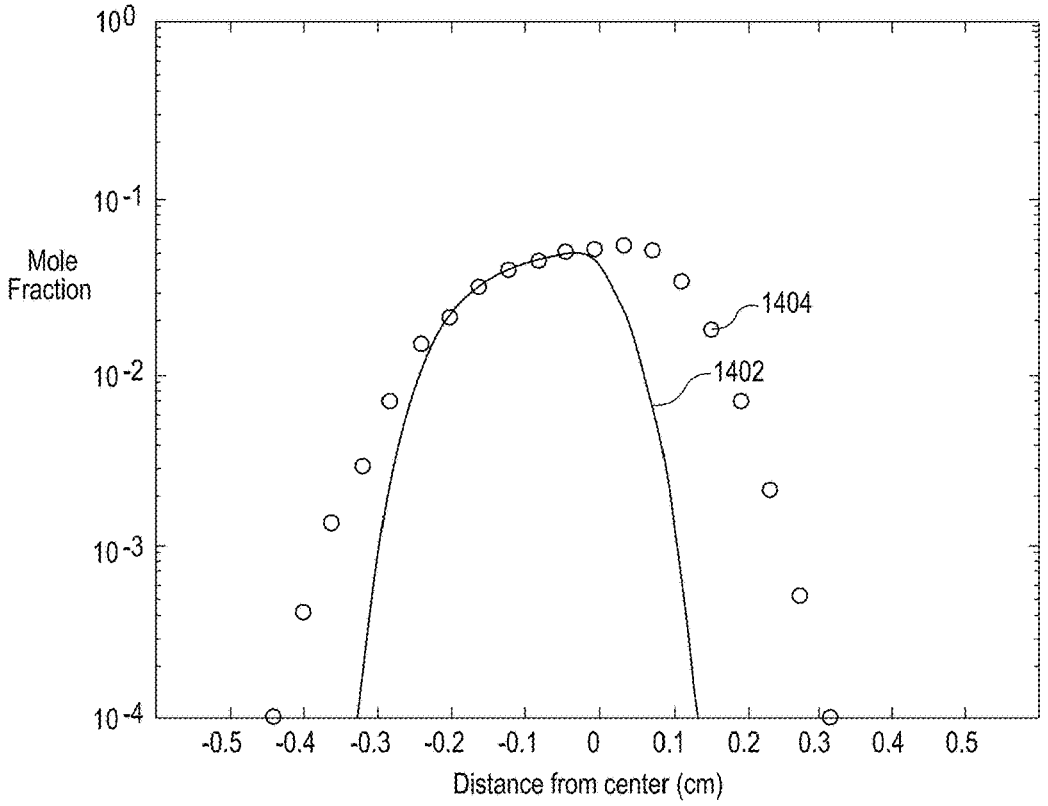
FIG. 14 shows a mole fraction profile of CO2 in the flame centerline of a N2-diluted, CH4-oxygen, counter-flow, non-premixed flame with data from Smooke et al. compared with computationally obtained data.
Figure 15:
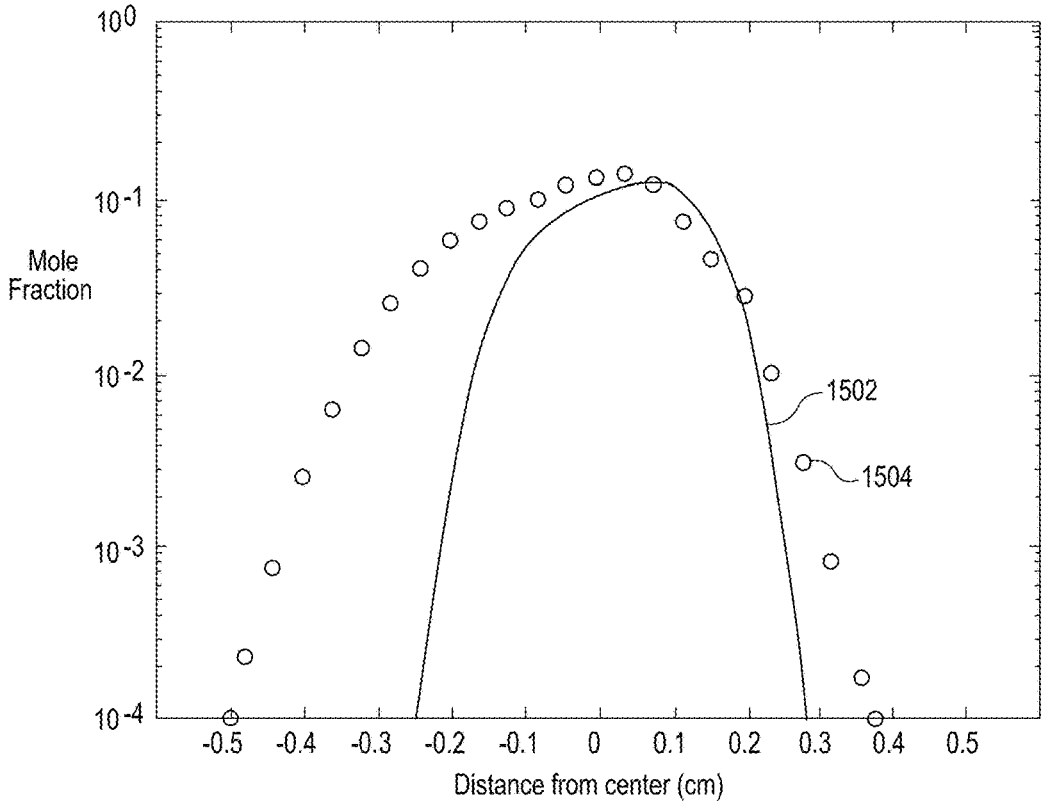
FIG. 15 shows a mole fraction profile of H2O in the flame centerline of a N2-diluted, CH4-oxygen, counter-flow, non-premixed flame with data from Smooke et al. compared with computationally obtained data.
Figure 16:
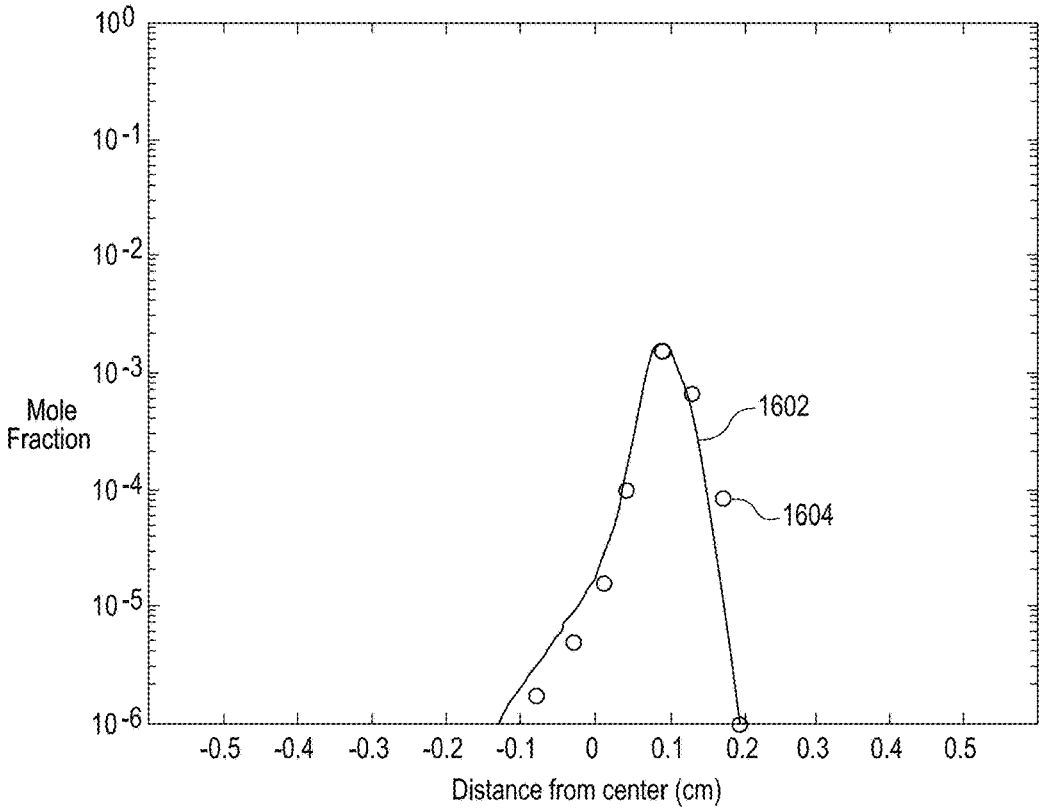
FIG. 16 shows a mole fraction profile of H in the flame centerline of a N2-diluted, CH4-oxygen, counter-flow, non-premixed flame with data from Smooke et al. compared with computationally obtained data.
Figure 17:
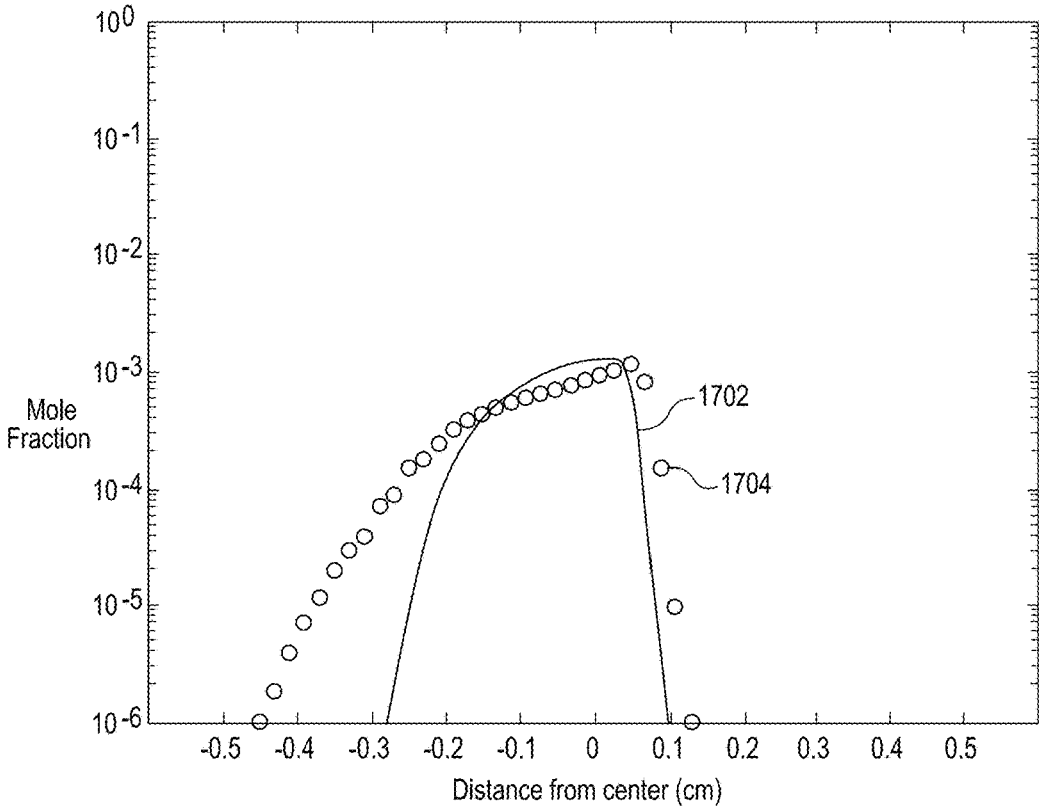
FIG. 17 shows a mole fraction profile of HCHO in the flame centerline of a N2-diluted, CH4-oxygen, counter-flow, non-premixed flame with data from Smooke et al. compared with computationally obtained data.

Temperature and mass fraction distributions based on the preliminary model described above are shown in FIGS. 13-17. For example, FIG. 13 shows a temperature profile for a N2-diluted, CH4-oxygen, counter-flow, non-premixed flame at the flame centerline (z=0), with data from Smooke et al. 1304 compared with the computationally obtained data 1302. FIG. 14 shows a mole fraction profile of CO2 in the flame centerline of a N2-diluted, CH4-oxygen, counter-flow, non-premixed flame with data from Smooke et al. 1404 compared with computationally obtained data 1402. FIG. 15 shows a mole fraction profile of $H_2O$ in the flame centerline of a N2-diluted, CH4-oxygen, counter-flow, non-premixed flame with data from Smooke et al. 1504 compared with computationally obtained data 1502. FIG. 16 shows a mole fraction profile of H in the flame centerline of a N2-diluted, CH4-oxygen, counter-flow, non-premixed flame with data from Smooke et al. 1604 compared with computationally obtained data 1602. And finally, FIG. 17 shows a mole fraction profile of HCHO in the flame centerline of a N2-diluted, CH4-oxygen, counter-flow, non-premixed flame with data from Smooke et al. 1704 compared with computationally obtained data 1702.

Each comparison described above was performed with respect to two aspects. First, FIGS. 13, 14 and 15 compare temperature and major combustion products, so that the capability of the computational tool is assessed in order to capture the macroscopic characteristics of the flame structure. The comparison is in general good, especially as it relates to the computation of the maximum values of both the temperature and the mole fractions. Also, the locations of the peak values between the two nozzles agree fairly closely. However, there are some deviations when the temperatures start to decrease from the peak. These discrepancies are attributed to the fact by that in the work of Smooke et al., an infinitely wide reactant jet was used, which of course could not be emulated precisely in the experiment. However, what is very encouraging is the very good agreement in minor combustion species (radicals like H and intermediates like HCHO) that the results of FIG. 7 show. This is important because according to the mechanism of chemi-ion generation suggested by Belhi et al. (2010), it is species like this that will carry the positive charge in the flame. In this sense, a computational tool has been established that can be coupled with the capability of ANSYS-Fluent for electrostatics calculations in order to analyze the physics of these flames.

Computational Calculation of the Properties

The compact notation embodied in the equations of the previous sections is used in order to solve chemical kinetics problems using CHEMKIN® (CHEMKIN-CFD for FLUENT 20112, Reaction Design: San Diego, 2013) coupled with ANSYS-Fluent. A detailed reaction mechanism can be written by considering all the elementary reactions and the chemical species (molecules, atoms, and free radicals) that take part in the overall reaction process. Fluent can read a mechanism file in CHEMKIN Format by importing three files: CHEMKIN mechanism file, the thermodynamics database file and transport data file.

An example of input file to the CHEMKIN Mechanism File for a hydrogen-oxidation reaction shown in FIG. 18. The first two lines specify the elements and number of species N. The left column lists the J reactions that constitute the mechanism in the form of Eq. (3.18). Each reaction is written in a row followed by the three Arrhenius coefficients: collision frequency factor $A_j$, the temperature-dependency exponent $\beta_j$ and the activation energy $E_{A_j}$. Some reactions include participation of a third body M and the coefficients of the collision efficiency $\alpha_{ij}$ for selected species are mentioned in the line following that for a reaction. Any chemical species that appear in the mechanism file must have thermodynamic data associated in a different file (Thermodynamics Database File). A sample of thermodynamics data for OH species is shown in FIG. 19. The numerical coefficients in the three lines below the name of a species i are used to find the specific heat $c_{p_i}$, enthalpyh $h_i$ and entropy $s_i^o$ at the reference pressure by substitution according to the NASA polynomials:

$$\frac{c_{p_i}(T)}{\Re} = a_1 + a_2T + a_3T^2 + a_4T^3 + a_5T^4,$$

$$\frac{h_i}{\Re T} = \frac{a_6}{T} + \frac{\int c_{p_i}(T)dT}{\Re T} = a_1 + \frac{a_2}{2}T + \frac{a_3}{3}T^2 + \frac{a_4}{4}T^3 + \frac{a_5}{5}T^4 + \frac{a_6}{T},$$

$$\frac{s_i^o}{\Re} = a_7 + \int\left(\frac{c_{p_i}(T)}{\Re T}\right)dT = a_1\ln(T) + a_2T + \frac{a_3}{2}T^2 + \frac{a_4}{3}T^3 + \frac{a_5}{4}T^4 + a_7,$$

The values of coefficients a1-a7 are given in the format shown in FIG. 19. In the particular example, in lines 2-4, we read the values of 14 constants. The first seven ones are the values of a1-a7 for the low-temperature regime 200 K<T<1000 K and the following constants are the values of a1-a7 for the high-temperature regime 1000 K<T<3500 K, as indicated by the information in line 1.

Finally, the transport properties file was used to evaluate the viscosities, thermal conductivities, diffusion coefficients, and thermal diffusion coefficients for any species in the mixture.

Different arrangements of the components depicted in the drawings or described above, as well as components and steps not shown or described are possible. Similarly, some features and sub-combinations are useful and may be employed without reference to other features and sub-combinations. Embodiments of the disclosure have been described for illustrative and not restrictive purposes, and alternative embodiments will become apparent to readers of this patent. Accordingly, the present disclosure is not limited to the embodiments described above or depicted in the drawings, and various embodiments and modifications may be made without departing from the scope of the claims below.

REFERENCES

Anderson, E. K., Koch, J. A., and Kyritsis, D. C. (2008). "Phenomenology of electrostatically charged droplet combustion in normal gravity." *Combust. Flame,* 154, 624-629.

Belhi, M., Domingo, P., and Vervish P. (2010). "Direct numerical simulation of the effect of an electric field on flame stability." *Combust. Flame,* 157, 2286-2297.

Burke S. P. and Schumann T. E. W. (1928) "Diffusion Flames", *Proceedings of the Combustion Institute,* 1, 2-11.

Calcote H. F. (1957) "Mechanisms for the formation of ions in flames," *Combustion and Flame,* 1, 385-403.

Goodings J., D. Bohme, and C. Ng (1979 I) "Detailed ion chemistry in methane-oxygen flames. I. Positive ions" Combustion and Flame, 36, 27-43.

Goodings J., D. Bohme, and C. Ng (1979 II) "Detailed ion chemistry in methane-oxygen flames. II. Negative ions" Combustion and Flame, 36, 45-62.

Gregory P. Smith, David M. Golden, Michael Frenklach, Nigel W. Moriarty, B. Eiteneer, Mikhail Goldenberg, C. Thomas Bowman, Ronald K. Hanson, Soonho Song, William C. Gardiner, Jr., Vitali V. Lissianski, and Zhiwei Qin http://www.me.berkeley.edu/gri_mech/.

Ju Y. and Sun W. (2015) "Plasma assisted combustion: Dynamics and Chemistry", *Progress in Energy and Combustion Science,* 48, 21-83.

Kim M. K., Chung S. H., Kim H. H. (2012) "Effect of the electric fields on the stabilization of premixed, laminar Bunsen flames at low AC frequency: Bi-ionic wind effect", *Combustion and Flame,* 159, 1151-1159.

Kyritsis D. C., Coriton B., Faure F., Roychoudhury S., and Gomez A. (2004) "Optimization of a catalytic combustor using electrosprayed liquid hydrocarbons for mesoscale power generation", *Combustion and Flame,* 139, 77-89.

Lenguito G., Fernandez—de la Mora, J., and Gomez A. (2014) "*Scaling up the power of an electrospray micro-thruster", j. of Micromechanics and Microengineering*, vol. 24, Article Number 055003.

Lewis B. (1931). "The effect of an electric field on flames and their propagation," *Journal of the American Chemical Society,* 53, 1304-1313.

Liñán A. (1974). "The asymptotic structure of counterflow diffusion flames for large activation energies" *Acta Astronautica,* 1, 1007-1039.

Papac M. and D. Dunn-Rankin (2007), "Modelling electric field driven convection in small combustion plasmas and surrounding gases," *Combustion Theory and Modelling,* 12, 23-44.

Seshadri, K., and Williams, F. A. (1978). "Laminar flow between parallel plates with injection of a reactant at high Reynolds number." *Int. J Heat Mass Transfer,* 21, 251-253.

Smooke, M. D., Puri, I. K. and Seshadri K. (1986). "A comparison between numerical calculations and experimental measurements of the structure of a counterflow diffusion flame burning diluted methane in diluted air." *Proceedings of the Combustion Institute,* 21 1783-1792.

Tang K. and Gomez A. (1994) "On the structure of an electrostatic spray of monodisperse droplets", *Physics of Fluids,* 6, 2317-2332.

Thong K. C. and F. J. Weinberg (1971) "Electric control of the combustion of solid and liquid particle suspensions" *Proc. Roy. Soc. Lond.,* 324, 201-210.

Yamashita, K., Karnani, S., and Dunn-Rankin, D. (2009). "Numerical prediction of ion current from a small methane jet flame." *Combust. Flame,* 156, 1227-1233.

What is claimed is:

1. A method of manipulating a flame, comprising:

generating a stable flame at a position between a fuel source and an oxidizer source arranged in a counterflow arrangement;

generating an electrostatic field between the fuel source and the oxidizer source by a first electrode and a second electrode, the first electrode positioned across a path of fuel exiting the fuel source and the second electrode positioned across a path of oxidizer exiting the oxidizer source such that a first flow comprising a fuel passes through the first electrode from the fuel source and a second flow comprising an oxidizer passes through the second electrode from the oxidizer source; and changing at least one of the position of the stable flame or a shape of the stable flame by applying a voltage to the first electrode or the second electrode.

2. The method of claim 1, wherein:

the fuel is a gaseous hydrocarbon and the first flow comprises a first gaseous mixture comprising the hydrocarbon; and the second flow comprises a second gaseous mixture comprising oxygen from the oxidizer source.

3. The method of claim 1, further comprising:

regulating the first flow by passing the fuel through a first glass bead bed before passing the first flow through the first electrode; and regulating the second flow by passing the oxidizer through a second glass bead bed prior to passing the second flow through the second electrode.

4. The method of claim 1, further comprising:

protecting the stable flame by passing a gaseous shroud comprising a non-oxidizing, non-combusting gas around the stable flame.

5. The method of claim 1, further comprising:

passing a coolant around the oxidizer source such that the flow of coolant cools the oxidizer source and protects the oxidizer source from heat produced by the flame.

6. The method of claim 1, wherein:

the fuel is a liquid hydrocarbon fuel; and the first flow comprises an aerosolized fuel mixture comprising the liquid hydrocarbon fuel.

7. The method of claim 1, further comprising:

positioning the stable flame proximate to a working surface by applying the voltage to the first electrode or to the second electrode such that the working surface is electrostatically negative relative to at least first electrode or the second electrode.

8. The method of claim 1, wherein the oxidizer source comprises a fan arranged to move air toward the stable flame.

9. The method of claim 1, wherein one of the first electrode or the second electrode is a negative electrode, and further comprising:

collapsing the stable flame proximate to the negative electrode.

10. The method of claim 1, further comprising:

moving the flame toward one of the oxidizer source or the fuel source by applying the voltage.

11. The method of claim 1, wherein the electric field is applied such that an electrostatic force exerted on the stable flame by the electric field opposes a buoyancy force caused by heat from the stable flame.

12. The method of claim 1, wherein:

the first electrode comprises a first conductive mesh positioned across a first outlet of the fuel source and the second electrode comprises a second conductive mesh positioned across a second outlet of the oxidizer source; and the first electrode and the second electrode are planar and parallel with each other.

13. An electrostatically controllable burner, comprising:

a fuel source;

an oxidizer source arranged proximate to the fuel source; and a first electrode positioned across a path of fuel exiting the fuel source and a second electrode positioned across a path of oxidizer exiting the oxidizer source, such that a first flow comprising a fuel passes through the first electrode and a second flow comprising an oxidizer passes through the second electrode, wherein the first electrode and the second electrode are configured to produce an electrostatic field between the fuel source and the oxidizer source, in response to an applied voltage between the first electrode and the second electrode, sufficient to change a position or a shape of a flame produced at a position between the fuel source and the oxidizer source.

14. The electrostatically controllable burner of claim 13, wherein the fuel source and the oxidizer source are arranged in a counter-flow arrangement.

15. The electrostatically controllable burner of claim 13, further comprising a coolant chamber connected with one of the fuel source and the oxidizer source and configured to cool the one of the fuel source and the oxidizer source.

16. The electrostatically controllable burner of claim 13, further comprising a shroud nozzle connected with one of the fuel source and the oxidizer source and configured to emit a gaseous shroud between the fuel source and the oxygen source.

17. The electrostatically controllable burner of claim 13, wherein the applied voltage between the first electrode and the second electrode is within a range from 0 kV to 6 kV.

18. The electrostatically controllable burner of claim 13, wherein the electrostatic field has an electric field strength of about 100 V/mm to about 1000 V/mm.

19. The electrostatically controllable burner of claim 13, wherein the second flow comprises a mixture of oxygen from an oxygen reservoir and a second gas from a second gaseous reservoir.

20. The electrostatically controllable burner of claim 13, wherein the first flow comprises a mixture of the fuel from a hydrocarbon fuel reservoir and a second gas from a second gaseous reservoir.

21. The electrostatically controllable burner of claim 13, wherein at least one of the first electrode or the second electrode comprises an electrically conducting mesh positioned across an outlet of the fuel source or the oxidizer source, respectively, and configured to allow passage of the first flow or the second flow therethrough.

22. The electrostatically controllable burner of claim 13, wherein the electric field is applied such that an electrostatic force exerted on the stable flame opposes a buoyancy force caused by heat from the stable flame.

* * * * *